US012680297B2

(12) United States Patent
Pilz

(10) Patent No.: US 12,680,297 B2
(45) Date of Patent: Jul. 14, 2026

(54) FIRE OR SOUND BLOCKING COMPONENTS AND WALL ASSEMBLIES WITH FIRE OR SOUND BLOCKING COMPONENTS

(71) Applicant: CEMCO, LLC, City of Industry, CA (US)

(72) Inventor: Donald Anthony Pilz, Livermore, CA (US)

(73) Assignee: CEMCO, LLC, City of Industry, CA (US)

( * ) Notice: Subject to any disclaimer, the term of this patent is extended or adjusted under 35 U.S.C. 154(b) by 266 days.

(21) Appl. No.: 18/528,534

(22) Filed: Dec. 4, 2023

(65) Prior Publication Data

US 2024/0175258 A1 May 30, 2024

Related U.S. Application Data

(63) Continuation of application No. 17/446,947, filed on Sep. 3, 2021, now Pat. No. 11,873,636, which is a continuation of application No. 16/541,951, filed on Aug. 15, 2019, now Pat. No. 11,111,666.

(60) Provisional application No. 62/870,933, filed on Jul. 5, 2019, provisional application No. 62/780,059, filed on Dec. 14, 2018, provisional application No. 62/775,801, filed on Dec. 5, 2018, provisional application No. 62/764,883, filed on Aug. 16, 2018.

(51) Int. Cl.
*E04B 1/94* (2006.01)

(52) U.S. Cl.
CPC ..... *E04B 1/948* (2013.01)

(58) Field of Classification Search
CPC ..... E04B 1/948; E04B 1/944; E04B 1/6801; E04B 1/6815; E04B 2/7411; E04B 2/7409; E04B 2/825
See application file for complete search history.

(56) References Cited

U.S. PATENT DOCUMENTS 661,832 A 11/1900 Wilkinson
716,628 A 12/1902 Dickey
965,595 A 7/1910 Nicholson
(Continued)

FOREIGN PATENT DOCUMENTS

CA 2234347 10/1999
CA 2498537 A1 8/2006
(Continued)

OTHER PUBLICATIONS

BlazeFrame 2009 catalog of products, available at least as of Mar. 4, 2010 from www.blazeframe.com, in 20 pages.
(Continued)

*Primary Examiner* — Theodore V Adamos
(74) *Attorney, Agent, or Firm* — VIA LLP

(57) ABSTRACT

Fire or sound blocking components are configured to resist the transmission of fire, heat or sound through a gap in a wall assembly. The components can be elongate and have a profile of a consistent cross-sectional shape along the length of the component. In some arrangements, the component is configured to provide fire or sound blocking to a dynamic head-of-wall joint of a wall assembly. In other arrangements, the component is configured to provide fire or sound blocking to a reveal gap within or along an edge of a wall assembly.

19 Claims, 13 Drawing Sheets

(56) References Cited

U.S. PATENT DOCUMENTS 1,130,722 A 3/1915 Fletcher
1,563,651 A 12/1925 Pomerantz
1,719,728 A 7/1929 Saunders
2,020,576 A 11/1935 Runde
2,105,771 A 1/1938 Holdsworth
2,114,386 A 4/1938 Killion
2,218,426 A 10/1940 Hulbert, Jr.
2,556,878 A 6/1951 Kohlhaas
2,664,739 A 1/1954 Marcy
2,683,927 A 7/1954 Maronek
2,733,786 A 2/1956 Drake
2,766,855 A 10/1956 Johnson et al.
2,994,114 A 8/1961 Black
3,041,682 A 7/1962 Alderfer et al.
3,129,792 A 4/1964 Gwynne
3,153,467 A 10/1964 Nelsson et al.
3,170,269 A 2/1965 Dunnington
3,197,119 A 7/1965 Hartig et al.
3,271,920 A 9/1966 Downing, Jr.
3,286,420 A 11/1966 Kenneth
3,305,993 A 2/1967 Nels
3,309,826 A 3/1967 Zinn
3,324,615 A 6/1967 Zinn
3,346,909 A 10/1967 Blackburn
3,355,852 A 12/1967 Lally
3,397,495 A 8/1968 Thompson
3,460,302 A 8/1969 Cooper
3,481,090 A 12/1969 Lizee
3,493,460 A 2/1970 Windecker
3,495,417 A 2/1970 Ratliff
3,537,219 A 11/1970 Navarre
3,562,985 A 2/1971 Nicosia
3,566,559 A 3/1971 Dickson
3,600,854 A 8/1971 Dallaire et al.
3,601,942 A 8/1971 Wilson
3,604,167 A 9/1971 Hays
3,609,933 A 10/1971 Jahn et al.
3,648,419 A 3/1972 Marks
3,668,041 A 6/1972 Lonning
3,683,569 A 8/1972 Holm
3,696,569 A 10/1972 Didry
3,707,819 A 1/1973 Calhoun et al.
3,713,263 A 1/1973 Mullen
3,730,477 A 5/1973 Wavrunek
3,744,199 A 7/1973 Navarre
3,757,480 A 9/1973 Young
3,786,604 A 1/1974 Kramer
3,837,126 A 9/1974 Voiturier et al.
3,839,839 A 10/1974 Tillisch et al.
3,866,370 A 2/1975 Guarino et al.
3,908,328 A 9/1975 Nelsson
3,921,346 A 11/1975 Sauer et al.
3,922,830 A 12/1975 Guarino et al.
3,934,066 A 1/1976 Murch
3,935,681 A 2/1976 Voiturier et al.
3,949,532 A 4/1976 Jonsson et al.
3,950,912 A 4/1976 Lundberg et al.
3,955,330 A 5/1976 Wendt
3,964,214 A 6/1976 Wendt
3,974,607 A 8/1976 Balinski
3,976,825 A 8/1976 Anderberg
3,998,027 A 12/1976 Wendt et al.
4,011,704 A 3/1977 O'Konski
4,017,090 A 4/1977 Cohen
4,034,526 A 7/1977 Deslaugiers
4,058,947 A 11/1977 Earle et al.
4,093,818 A 6/1978 Thwaites et al.
4,103,463 A 8/1978 Dixon
4,114,335 A 9/1978 Carroll
4,122,203 A 10/1978 Stahl
4,130,972 A 12/1978 Varlonga
4,139,664 A 2/1979 Wenrick
4,144,385 A 3/1979 Downing
4,152,878 A 5/1979 Balinski
4,164,107 A 8/1979 Kraemling et al.
4,176,503 A 12/1979 Ting
4,178,728 A 12/1979 Ortmanns et al.
4,197,687 A 4/1980 Benoit
4,203,264 A 5/1980 Kiefer et al.
4,205,498 A 6/1980 Unayama
4,217,731 A 8/1980 Saino
4,269,890 A 5/1981 Breitling et al.
4,276,332 A 6/1981 Castle
4,281,494 A 8/1981 Weinar
4,283,892 A 8/1981 Brown
4,295,304 A 10/1981 Kim
4,318,253 A 3/1982 Wedel
4,320,611 A 3/1982 Freeman
4,324,835 A 4/1982 Keen
4,329,820 A 5/1982 Wendt
4,356,672 A 11/1982 Beckman et al.
4,361,994 A 12/1982 Carver
4,419,535 A 12/1983 O'Hara
4,424,653 A 1/1984 Heinen
4,433,732 A 2/1984 Licht et al.
4,434,592 A 3/1984 Reneault et al.
4,437,274 A 3/1984 Slocum et al.
4,454,690 A 6/1984 Dixon
4,461,120 A 7/1984 Hemmerling
4,467,578 A 8/1984 Weinar
4,480,419 A 11/1984 Crites
4,495,238 A 1/1985 Adiletta
4,497,150 A 2/1985 Wendt et al.
4,507,901 A 4/1985 Carroll
4,509,559 A 4/1985 Cheetham et al.
4,517,782 A 5/1985 Shamszadeh
4,530,877 A 7/1985 Hadley
4,574,454 A 3/1986 Dyson
4,575,979 A 3/1986 Mariani
4,578,913 A 4/1986 Eich
4,598,516 A 7/1986 Groshong
4,622,791 A 11/1986 Cook et al.
4,622,794 A 11/1986 Geortner
4,632,865 A 12/1986 Tzur
4,649,089 A 3/1987 Thwaites
4,663,204 A 5/1987 Langham
4,672,785 A 6/1987 Salvo
4,709,517 A 12/1987 Mitchell et al.
4,711,183 A 12/1987 Handler et al.
4,723,385 A 2/1988 Kallstrom
4,756,945 A 7/1988 Gibb
4,761,927 A 8/1988 O'Keeffe et al.
4,787,767 A 11/1988 Wendt
4,788,802 A 12/1988 Wokas
4,798,035 A 1/1989 Mitchell et al.
4,805,364 A 2/1989 Smolik
4,810,986 A 3/1989 Leupold
4,822,659 A 4/1989 Anderson et al.
4,825,610 A 5/1989 Gasteiger
4,830,913 A 5/1989 Ortmans et al.
4,845,904 A 7/1989 Menchetti
4,850,173 A 7/1989 Beyer et al.
4,850,385 A 7/1989 Harbeke
4,854,096 A 8/1989 Smolik
4,854,107 A 8/1989 Roberts
4,866,898 A 9/1989 LaRoche et al.
4,881,352 A 11/1989 Glockenstein
4,884,381 A 12/1989 Betti
4,885,884 A 12/1989 Schilger
4,897,976 A 2/1990 Williams et al.
4,899,510 A 2/1990 Propst
4,914,880 A 4/1990 Albertini
4,918,761 A 4/1990 Harbeke
4,930,276 A 6/1990 Bawa et al.
4,935,281 A 6/1990 Tolbert et al.
4,982,540 A 1/1991 Thompson
4,986,040 A 1/1991 Prewer et al.
4,987,719 A 1/1991 Goodson, Jr.
4,992,310 A 2/1991 Gelb et al.
5,010,702 A 4/1991 Daw et al.
5,058,342 A 10/1991 Crompton
5,067,676 A 11/1991 Belle
5,079,088 A 1/1992 McGroarty
5,090,170 A 2/1992 Propst

(56) References Cited

U.S. PATENT DOCUMENTS

| | | | |
|---|---|---|---|
| 5,094,780 | A | 3/1992 | von Bonin |
| 5,098,778 | A | 3/1992 | Minnick |
| 5,103,589 | A | 4/1992 | Crawford |
| 5,105,594 | A | 4/1992 | Kirchner |
| 5,111,579 | A | 5/1992 | Andersen |
| 5,125,203 | A | 6/1992 | Daw |
| 5,127,203 | A | 7/1992 | Paquette |
| 5,127,760 | A | 7/1992 | Brady |
| 5,140,792 | A | 8/1992 | Daw et al. |
| 5,146,723 | A | 9/1992 | Greenwood et al. |
| 5,152,113 | A | 10/1992 | Guddas |
| 5,155,957 | A | 10/1992 | Robertson et al. |
| 5,157,883 | A | 10/1992 | Meyer |
| 5,157,887 | A | 10/1992 | Watterworth, III |
| 5,167,876 | A | 12/1992 | Lem |
| 5,173,515 | A | 12/1992 | von Bonin et al. |
| 5,203,132 | A | 4/1993 | Smolik |
| 5,205,099 | A | 4/1993 | Grünhage et al. |
| 5,212,914 | A | 5/1993 | Martin et al. |
| 5,214,894 | A | 6/1993 | Glesser-Lott |
| 5,222,335 | A | 6/1993 | Petrecca |
| 5,228,254 | A | 7/1993 | Honeycutt, Jr. |
| 5,244,709 | A | 9/1993 | Vanderstukken |
| 5,279,087 | A | 1/1994 | Mann |
| 5,279,088 | A | 1/1994 | Heydon |
| 5,279,091 | A | 1/1994 | Williams et al. |
| 5,285,615 | A | 2/1994 | Gilmour |
| 5,307,600 | A | 5/1994 | Simon et al. |
| 5,315,804 | A | 5/1994 | Attalla |
| 5,319,339 | A | 6/1994 | Leupold |
| 5,325,651 | A | 7/1994 | Meyer et al. |
| 5,339,577 | A | 8/1994 | Snyder |
| 5,347,780 | A | 9/1994 | Richards et al. |
| 5,367,850 | A | 11/1994 | Nicholas |
| 5,374,036 | A | 12/1994 | Rogers et al. |
| 5,376,429 | A | 12/1994 | McGroarty |
| 5,390,458 | A | 2/1995 | Menchetti |
| 5,390,465 | A | 2/1995 | Rajecki |
| 5,394,665 | A | 3/1995 | Johnson |
| 5,412,919 | A | 5/1995 | Pellock et al. |
| 5,433,991 | A | 7/1995 | Boyd, Jr. et al. |
| 5,452,551 | A | 9/1995 | Charland et al. |
| 5,454,203 | A | 10/1995 | Turner |
| 5,456,050 | A | 10/1995 | Ward |
| 5,460,864 | A | 10/1995 | Heitkamp |
| 5,471,791 | A | 12/1995 | Keller |
| 5,471,805 | A | 12/1995 | Becker |
| 5,475,961 | A | 12/1995 | Menchetti |
| 5,477,652 | A | 12/1995 | Torrey et al. |
| 5,481,834 | A | 1/1996 | Kowalczyk et al. |
| 5,502,937 | A | 4/1996 | Wilson |
| 5,505,031 | A | 4/1996 | Heydon |
| 5,531,051 | A | 7/1996 | Chenier, Jr. et al. |
| 5,552,185 | A | 9/1996 | De Keyser |
| 5,592,796 | A | 1/1997 | Landers |
| 5,604,024 | A | 2/1997 | von Bonin |
| 5,607,758 | A | 3/1997 | Schwartz |
| 5,644,877 | A | 7/1997 | Wood |
| 5,687,532 | A | 11/1997 | Torrey |
| 5,687,538 | A | 11/1997 | Frobosilo et al. |
| 5,689,922 | A | 11/1997 | Daudet |
| 5,694,726 | A | 12/1997 | Wu |
| 5,709,821 | A | 1/1998 | von Bonin et al. |
| 5,724,784 | A | 3/1998 | Menchetti |
| 5,735,100 | A | 4/1998 | Campbell |
| 5,740,635 | A | 4/1998 | Gil et al. |
| 5,740,643 | A | 4/1998 | Huntley |
| 5,755,066 | A | 5/1998 | Becker |
| 5,765,332 | A | 6/1998 | Landin et al. |
| 5,782,690 | A | 7/1998 | Gustafson et al. |
| 5,787,651 | A | 8/1998 | Horn et al. |
| 5,797,233 | A | 8/1998 | Hascall |
| 5,798,679 | A | 8/1998 | Pissanetzky |
| 5,806,261 | A | 9/1998 | Huebner et al. |
| 5,809,721 | A | 9/1998 | Antropius |
| 5,820,958 | A | 10/1998 | Swallow |
| 5,822,935 | A | 10/1998 | Mitchell et al. |
| 5,870,866 | A | 2/1999 | Herndon |
| 5,913,788 | A | 6/1999 | Herren |
| 5,921,041 | A | 7/1999 | Egri, II |
| 5,927,041 | A | 7/1999 | Sedlmeier et al. |
| 5,930,963 | A | 8/1999 | Nichols |
| 5,930,968 | A | 8/1999 | Pullman |
| 5,945,182 | A | 8/1999 | Fowler et al. |
| 5,950,385 | A | 9/1999 | Herren |
| 5,968,615 | A | 10/1999 | Schlappa |
| 5,968,669 | A | 10/1999 | Liu et al. |
| 5,970,672 | A | 10/1999 | Robinson |
| 5,974,750 | A | 11/1999 | Landin et al. |
| 5,974,753 | A | 11/1999 | Hsu |
| 6,023,898 | A | 2/2000 | Josey |
| 6,058,668 | A | 5/2000 | Herren |
| 6,061,985 | A | 5/2000 | Kraus et al. |
| 6,086,709 | A | 7/2000 | Hills |
| 6,110,559 | A | 8/2000 | De Keyser |
| 6,119,411 | A | 9/2000 | Gil et al. |
| 6,125,608 | A | 10/2000 | Charlson |
| 6,128,874 | A | 10/2000 | Olson et al. |
| 6,128,877 | A | 10/2000 | Goodman et al. |
| 6,131,352 | A | 10/2000 | Barnes et al. |
| 6,151,858 | A | 11/2000 | Ruiz et al. |
| 6,153,668 | A | 11/2000 | Gestner et al. |
| 6,176,053 | B1 | 1/2001 | St. Germain |
| 6,182,407 | B1 | 2/2001 | Turpin et al. |
| 6,189,277 | B1 | 2/2001 | Boscamp |
| 6,207,077 | B1 | 3/2001 | Burnell-Jones |
| 6,207,085 | B1 | 3/2001 | Ackerman |
| 6,213,679 | B1 | 4/2001 | Frobosilo et al. |
| 6,216,404 | B1 | 4/2001 | Vellrath |
| 6,233,888 | B1 | 5/2001 | Wu |
| 6,256,948 | B1 | 7/2001 | Van Dreumel |
| 6,256,960 | B1 | 7/2001 | Babcock et al. |
| 6,279,289 | B1 | 8/2001 | Soder et al. |
| 6,305,133 | B1 | 10/2001 | Cornwall |
| 6,318,044 | B1 | 11/2001 | Campbell |
| 6,374,558 | B1 | 4/2002 | Surowiecki |
| 6,381,913 | B2 | 5/2002 | Herren |
| 6,393,774 | B1 | 5/2002 | Fisher |
| 6,405,502 | B1 | 6/2002 | Cornwall |
| 6,408,578 | B1 | 6/2002 | Tanaka et al. |
| 6,430,881 | B1 | 8/2002 | Daudet et al. |
| 6,470,638 | B1 | 10/2002 | Larson |
| 6,487,825 | B1 | 12/2002 | Silik |
| 6,536,169 | B2 | 3/2003 | Dykhoff |
| 6,574,930 | B2 | 6/2003 | Kiser |
| 6,606,831 | B2 | 8/2003 | Degelsegger |
| 6,647,691 | B2 | 11/2003 | Becker et al. |
| 6,668,499 | B2 | 12/2003 | Degelsegger |
| 6,679,015 | B1 | 1/2004 | Cornwall |
| 6,688,056 | B2 | 2/2004 | Von Hoyningen Huene et al. |
| 6,698,146 | B2 | 3/2004 | Morgan et al. |
| 6,705,047 | B2 | 3/2004 | Yulkowski |
| 6,708,627 | B1 | 3/2004 | Wood |
| 6,711,871 | B2 | 3/2004 | Beirise et al. |
| 6,732,481 | B2 | 5/2004 | Stahl, Sr. |
| 6,739,926 | B2 | 5/2004 | Riach et al. |
| 6,748,705 | B2 | 6/2004 | Orszulak |
| 6,783,345 | B2 | 8/2004 | Morgan et al. |
| 6,792,733 | B2 | 9/2004 | Wheeler et al. |
| 6,799,404 | B2 | 10/2004 | Spransy |
| 6,820,382 | B1 | 11/2004 | Chambers et al. |
| 6,843,035 | B1 | 1/2005 | Glynn |
| 6,854,237 | B2 | 2/2005 | Surowiecki |
| 6,871,470 | B1 | 3/2005 | Stover |
| 6,944,997 | B2 | 9/2005 | Verkamp |
| 6,951,162 | B1 | 10/2005 | Shockey et al. |
| 6,955,017 | B2 | 10/2005 | Hilburn |
| 6,996,944 | B2 | 2/2006 | Shaw |
| 7,043,880 | B2 | 5/2006 | Morgan et al. |
| 7,059,092 | B2 | 6/2006 | Harkins et al. |
| 7,104,024 | B1 | 9/2006 | deGirolamo et al. |
| 7,152,385 | B2 | 12/2006 | Morgan et al. |
| 7,191,845 | B2 | 3/2007 | Loar |
| 7,240,905 | B1 | 7/2007 | Stahl |

(56) References Cited

U.S. PATENT DOCUMENTS

| | | | |
|---|---|---|---|
| 7,251,918 | B2 | 8/2007 | Reif et al. |
| 7,284,355 | B2 | 10/2007 | Becker et al. |
| 7,302,776 | B2 | 12/2007 | Duncan et al. |
| 7,398,856 | B2 | 7/2008 | Foster et al. |
| 7,413,024 | B1 | 8/2008 | Simontacchi et al. |
| 7,441,565 | B2 | 10/2008 | Imamura et al. |
| 7,487,591 | B2 | 2/2009 | Harkins et al. |
| 7,497,056 | B2 | 3/2009 | Surowiecki |
| 7,506,478 | B2 | 3/2009 | Bobenhausen |
| 7,513,082 | B2 | 4/2009 | Johnson |
| 7,540,118 | B2 | 6/2009 | Jensen |
| 7,594,331 | B2 | 9/2009 | Andrews et al. |
| 7,603,823 | B2 | 10/2009 | Cann |
| 7,610,725 | B2 | 11/2009 | Willert |
| 7,617,643 | B2 | 11/2009 | Pilz et al. |
| 7,681,365 | B2 | 3/2010 | Klein |
| 7,685,792 | B2 | 3/2010 | Stahl, Sr. et al. |
| 7,716,891 | B2 | 5/2010 | Radford |
| 7,735,295 | B2 | 6/2010 | Surowiecki |
| 7,752,817 | B2 | 7/2010 | Pilz et al. |
| 7,770,348 | B2 | 8/2010 | Tollenaar |
| 7,775,006 | B2 | 8/2010 | Giannos |
| 7,776,170 | B2 | 8/2010 | Yu et al. |
| 7,797,893 | B2 | 9/2010 | Stahl, Sr. et al. |
| 7,810,295 | B2 | 10/2010 | Thompson |
| 7,814,718 | B2 | 10/2010 | Klein |
| 7,827,738 | B2 | 11/2010 | Abrams et al. |
| 7,836,652 | B2 | 11/2010 | Futterman |
| 7,866,108 | B2 | 1/2011 | Klein |
| 7,870,698 | B2 | 1/2011 | Tonyan et al. |
| 7,921,537 | B2 | 4/2011 | Rodlin |
| 7,921,614 | B2 | 4/2011 | Fortin et al. |
| 7,941,981 | B2 | 5/2011 | Shaw |
| 7,950,198 | B2 | 5/2011 | Pilz et al. |
| 7,966,778 | B2 | 6/2011 | Klein |
| 7,984,592 | B1 | 7/2011 | Jiras |
| 8,029,345 | B2 | 10/2011 | Messmer et al. |
| 8,056,293 | B2 | 11/2011 | Klein |
| 8,061,099 | B2 | 11/2011 | Andrews |
| 8,062,108 | B2 | 11/2011 | Carlson et al. |
| 8,069,625 | B2 | 12/2011 | Harkins et al. |
| 8,074,412 | B1 | 12/2011 | Gogan et al. |
| 8,074,416 | B2 | 12/2011 | Andrews |
| 8,079,188 | B2 | 12/2011 | Swartz et al. |
| 8,087,205 | B2 | 1/2012 | Pilz et al. |
| 8,096,084 | B2 | 1/2012 | Studebaker et al. |
| 8,100,164 | B2 | 1/2012 | Goodman et al. |
| 8,132,376 | B2 | 3/2012 | Pilz et al. |
| 8,136,314 | B2 | 3/2012 | Klein |
| 8,151,526 | B2 | 4/2012 | Klein |
| 8,181,404 | B2 | 5/2012 | Klein |
| 8,225,581 | B2 | 7/2012 | Strickland et al. |
| 8,281,552 | B2 | 10/2012 | Pilz et al. |
| 8,286,397 | B2 | 10/2012 | Shaw |
| 8,318,304 | B2 | 11/2012 | Valenziano |
| 8,322,094 | B2 | 12/2012 | Pilz et al. |
| 8,353,139 | B2 | 1/2013 | Pilz |
| 8,375,666 | B2 | 2/2013 | Stahl, Jr. et al. |
| 8,389,107 | B2 | 3/2013 | Riebel et al. |
| 8,413,394 | B2 | 4/2013 | Pilz et al. |
| 8,453,413 | B2 | 6/2013 | Matiere |
| 8,468,759 | B2 | 6/2013 | Klein |
| 8,495,844 | B1 | 7/2013 | Johnson |
| 8,499,512 | B2 | 8/2013 | Pilz et al. |
| 8,539,732 | B2 | 9/2013 | Leahy |
| 8,541,084 | B2 | 9/2013 | Deiss et al. |
| 8,544,226 | B2 | 10/2013 | Rubel |
| 8,551,594 | B2 | 10/2013 | Deiss |
| 8,555,566 | B2 | 10/2013 | Pilz et al. |
| 8,578,672 | B2 | 11/2013 | Mattox et al. |
| 8,584,415 | B2 | 11/2013 | Stahl, Jr. et al. |
| 8,590,231 | B2 | 11/2013 | Pilz |
| 8,595,999 | B1 | 12/2013 | Pilz et al. |
| 8,596,019 | B2 | 12/2013 | Aitken |
| 8,601,760 | B2 | 12/2013 | Hilburn, Jr. |
| 8,607,519 | B2 | 12/2013 | Hilburn |
| 8,640,415 | B2 | 2/2014 | Pilz et al. |
| 8,646,235 | B2 | 2/2014 | Hilburn, Jr. |
| 8,671,632 | B2 | 3/2014 | Pilz et al. |
| 8,695,301 | B2 | 4/2014 | Lutkajtis et al. |
| 8,728,608 | B2 | 5/2014 | Maisch |
| 8,782,977 | B2 | 7/2014 | Burgess |
| 8,793,946 | B2 | 8/2014 | Stahl et al. |
| 8,793,947 | B2 | 8/2014 | Pilz et al. |
| 8,826,599 | B2 | 9/2014 | Stahl |
| 8,871,326 | B2 | 10/2014 | Flennert |
| 8,938,922 | B2 | 1/2015 | Pilz et al. |
| 8,950,132 | B2 | 2/2015 | Collins et al. |
| 8,955,275 | B2 | 2/2015 | Stahl, Jr. |
| 8,973,319 | B2 | 3/2015 | Pilz et al. |
| 9,045,899 | B2 | 6/2015 | Pilz et al. |
| 9,127,454 | B2 | 9/2015 | Pilz et al. |
| 9,151,042 | B2 | 10/2015 | Simon et al. |
| 9,157,232 | B2 | 10/2015 | Stahl, Jr. |
| 9,163,444 | B1 | 10/2015 | Fontijn et al. |
| 9,206,596 | B1 | 12/2015 | Robinson |
| 9,284,730 | B2 | 3/2016 | Klein |
| 9,290,932 | B2 | 3/2016 | Pilz et al. |
| 9,290,934 | B2 | 3/2016 | Pilz et al. |
| 9,316,133 | B2 | 4/2016 | Schnitta |
| 9,371,644 | B2 | 6/2016 | Pilz et al. |
| 9,382,709 | B2 | 7/2016 | Collins et al. |
| 9,458,628 | B2 | 10/2016 | Pilz et al. |
| 9,481,998 | B2 | 11/2016 | Pilz et al. |
| 9,506,245 | B2 | 11/2016 | Mackintosh |
| 9,506,246 | B2 | 11/2016 | Joseph et al. |
| 9,512,614 | B2 | 12/2016 | Klein et al. |
| 9,523,193 | B2 | 12/2016 | Pilz |
| 9,551,148 | B2 | 1/2017 | Pilz |
| 9,616,259 | B2 | 4/2017 | Pilz et al. |
| 9,637,914 | B2 | 5/2017 | Pilz et al. |
| 9,677,268 | B2 | 6/2017 | Knight et al. |
| 9,683,364 | B2 | 6/2017 | Pilz et al. |
| 9,719,253 | B2 | 8/2017 | Stahl, Jr. et al. |
| 9,739,052 | B2 | 8/2017 | Pilz et al. |
| 9,739,054 | B2 | 8/2017 | Pilz et al. |
| 9,752,318 | B2 | 9/2017 | Pilz |
| 9,845,597 | B1 | 12/2017 | Shaw et al. |
| 9,879,421 | B2 | 1/2018 | Pilz |
| 9,883,607 | B2 | 1/2018 | Bernard |
| 9,885,178 | B1 | 2/2018 | Barnes et al. |
| 9,909,298 | B2 | 3/2018 | Pilz |
| 9,931,527 | B2 | 4/2018 | Pilz et al. |
| 9,995,039 | B2 | 6/2018 | Pilz et al. |
| 9,995,040 | B2 | 6/2018 | Stahl et al. |
| 10,000,923 | B2 | 6/2018 | Pilz |
| 10,010,805 | B2 | 7/2018 | Maxam et al. |
| 10,011,983 | B2 | 7/2018 | Pilz et al. |
| 10,036,155 | B2 | 7/2018 | Carless |
| 10,066,385 | B2 | 9/2018 | Foerg et al. |
| 10,077,550 | B2 | 9/2018 | Pilz |
| 10,100,514 | B2 | 10/2018 | Klein et al. |
| 10,166,418 | B2 | 1/2019 | Förg et al. |
| 10,174,499 | B1 | 1/2019 | Tinianov et al. |
| 10,184,246 | B2 | 1/2019 | Pilz et al. |
| 10,203,035 | B1 | 2/2019 | Robinson |
| 10,214,901 | B2 | 2/2019 | Pilz et al. |
| 10,227,775 | B2 | 3/2019 | Pilz et al. |
| 10,246,871 | B2 | 4/2019 | Pilz |
| 10,309,100 | B2 | 6/2019 | Long et al. |
| 10,323,409 | B1 | 6/2019 | Robinson |
| 10,323,411 | B2 | 6/2019 | Ackerman et al. |
| 10,406,389 | B2 | 9/2019 | Pilz et al. |
| 10,472,819 | B2 | 11/2019 | Klein et al. |
| 10,480,654 | B2 | 11/2019 | Robinson |
| 10,494,818 | B2 | 12/2019 | Maziarz |
| 10,519,652 | B2 | 12/2019 | Klein et al. |
| 10,538,915 | B1 | 1/2020 | Zemler et al. |
| 10,563,399 | B2 | 2/2020 | Pilz et al. |
| 10,619,347 | B2 | 4/2020 | Pilz et al. |
| 10,626,598 | B2 | 4/2020 | Klein |
| 10,669,710 | B2 | 6/2020 | Förg |
| 10,689,842 | B2 | 6/2020 | Pilz |
| 10,731,338 | B1 | 8/2020 | Zemler et al. |

(56) References Cited

U.S. PATENT DOCUMENTS 10,753,084 B2 8/2020 Pilz et al.
10,851,542 B2 12/2020 Hensley et al.
10,900,223 B2 1/2021 Pilz
10,914,065 B2 2/2021 Pilz
10,919,262 B2 2/2021 Zhu et al.
10,920,416 B2 2/2021 Klein et al.
10,954,670 B2 3/2021 Pilz
11,041,306 B2 6/2021 Pilz et al.
11,060,283 B2 7/2021 Pilz et al.
11,111,666 B2 9/2021 Pilz
11,118,346 B2 9/2021 Klein et al.
11,136,767 B2 10/2021 Foerg et al.
11,141,613 B2 10/2021 Pilz et al.
11,149,432 B2 10/2021 Gatland et al.
11,162,259 B2 11/2021 Pilz
11,230,839 B2 1/2022 Klein et al.
11,268,274 B2 3/2022 Pilz
11,280,084 B2 3/2022 Pilz
11,299,884 B2 4/2022 Stahl, Jr. et al.
11,313,121 B2 4/2022 Quirijns et al.
11,359,369 B2 6/2022 Sonney et al.
11,401,711 B2 8/2022 Klein
11,421,417 B2 8/2022 Pilz et al.
11,466,449 B2 10/2022 Pilz et al.
11,486,150 B2 11/2022 Stahl et al.
11,512,464 B2 11/2022 Klein
11,560,712 B2 1/2023 Pilz et al.
11,674,304 B2 6/2023 Landreth et al.
11,697,937 B2 7/2023 Campbell
11,713,572 B2 8/2023 Zemler et al.
11,732,465 B2 8/2023 Austin et al.
11,773,587 B2 10/2023 Pilz et al.
11,802,404 B2 10/2023 Pilz et al.
11,808,036 B2 11/2023 Klein et al.
11,866,932 B2 1/2024 Pilz et al.
11,873,636 B2 1/2024 Pilz et al.
11,891,800 B2 2/2024 Pilz
11,896,859 B2 2/2024 Pilz et al.
11,898,346 B2 2/2024 Pilz
11,905,705 B2 2/2024 Pilz et al.
11,920,343 B2 3/2024 Pilz
11,920,344 B2 3/2024 Pilz
11,933,042 B2 3/2024 Pilz
2002/0029535 A1 3/2002 Loper
2002/0095908 A1 7/2002 Kiser
2002/0160149 A1 10/2002 Garofalo
2002/0170249 A1 11/2002 Yulkowski
2003/0079425 A1 5/2003 Morgan et al.
2003/0089062 A1 5/2003 Morgan et al.
2003/0196401 A1 10/2003 Surowiecki
2003/0213211 A1 11/2003 Morgan et al.
2004/0010998 A1 1/2004 Turco
2004/0016191 A1 1/2004 Whitty
2004/0045234 A1 3/2004 Morgan et al.
2004/0139684 A1 7/2004 Menendez
2004/0149390 A1 8/2004 Monden et al.
2004/0157012 A1 8/2004 Miller et al.
2004/0211150 A1 10/2004 Bobenhausen
2005/0031843 A1 2/2005 Robinson et al.
2005/0034389 A1 2/2005 Boot et al.
2005/0183361 A1 8/2005 Frezza
2005/0246973 A1 11/2005 Jensen
2006/0032163 A1 2/2006 Korn
2006/0096200 A1 5/2006 Daudet
2006/0123723 A1 6/2006 Weir et al.
2006/0137293 A1 6/2006 Klein
2006/0213138 A1 9/2006 Milani et al.
2006/0261223 A1 11/2006 Orndorff, II et al.
2006/0277841 A1 12/2006 Majusiak
2007/0056245 A1 3/2007 Edmondson
2007/0068101 A1 3/2007 Weir et al.
2007/0125027 A1 6/2007 Klein
2007/0130873 A1 6/2007 Fisher
2007/0193202 A1 8/2007 Rice
2007/0261343 A1 11/2007 Stahl, Sr.
2008/0053013 A1 3/2008 Tollenaar
2008/0087366 A1 4/2008 Yu et al.
2008/0134589 A1 6/2008 Abrams et al.
2008/0172967 A1 7/2008 Hilburn
2008/0196337 A1 8/2008 Surowiecki
2008/0250738 A1 10/2008 Howchin
2009/0090074 A1 4/2009 Klein
2009/0107064 A1 4/2009 Bowman
2009/0197060 A1 8/2009 Cho
2009/0223159 A1 9/2009 Colon
2009/0241465 A1 10/2009 Majors
2009/0260303 A1 10/2009 Jensen
2009/0282760 A1 11/2009 Sampson et al.
2009/0320392 A1 12/2009 Nowoczin et al.
2010/0115868 A1 5/2010 Shaw et al.
2010/0199583 A1 8/2010 Behrens et al.
2010/0266781 A1 10/2010 Kusinski et al.
2011/0011019 A1 1/2011 Stahl, Jr. et al.
2011/0016808 A1 1/2011 Hulburn, Jr.
2011/0041415 A1 2/2011 Esposito
2011/0056163 A1 3/2011 Kure
2011/0067328 A1 3/2011 Naccarato et al.
2011/0099928 A1 5/2011 Klein et al.
2011/0113709 A1 5/2011 Pilz et al.
2011/0123801 A1 5/2011 Valenciano
2011/0146180 A1 6/2011 Klein
2011/0167742 A1 7/2011 Klein
2011/0185656 A1 8/2011 Klein
2011/0214371 A1 9/2011 Klein
2011/0247281 A1 10/2011 Pilz et al.
2011/0262720 A1 10/2011 Riebel et al.
2011/0274886 A1 11/2011 Flennert
2011/0302857 A1 12/2011 McClellan et al.
2012/0023846 A1 2/2012 Mattox et al.
2012/0180414 A1 7/2012 Burgess
2012/0247038 A1 10/2012 Black
2012/0266550 A1 10/2012 Naccarato et al.
2012/0297710 A1 11/2012 Klein
2013/0031856 A1 2/2013 Pilz et al.
2013/0118102 A1 5/2013 Pilz
2013/0118764 A1 5/2013 Porter
2013/0133844 A1 5/2013 Smart et al.
2013/0205694 A1 8/2013 Stahl, Jr.
2014/0219719 A1 8/2014 Hensley et al.
2014/0260017 A1 9/2014 Noble, III
2014/0345886 A1 11/2014 Yano et al.
2015/0086793 A1 3/2015 Kreysler et al.
2015/0135622 A1 5/2015 Muenzenberger et al.
2015/0135631 A1 5/2015 Förg
2015/0275506 A1 10/2015 Klein et al.
2015/0275507 A1 10/2015 Klein et al.
2015/0275510 A1 10/2015 Klein et al.
2015/0354210 A1 12/2015 Stahl, Jr. et al.
2015/0368898 A1 12/2015 Stahl, Jr. et al.
2016/0016381 A1 1/2016 Celis Marin
2016/0017598 A1 1/2016 Klein et al.
2016/0017599 A1 1/2016 Klein et al.
2016/0201893 A1 7/2016 Ksiezppolski
2016/0265219 A1 9/2016 Pilz
2016/0296775 A1 10/2016 Pilz et al.
2016/0340586 A1 11/2016 Auth et al.
2016/0348357 A1 12/2016 Smith et al.
2017/0016227 A1 1/2017 Klein
2017/0175386 A1* 6/2017 Pilz ..... E04B 1/944
2017/0232281 A1 8/2017 Rakic
2017/0234004 A1* 8/2017 Pilz ..... E04B 1/6801 52/232
2017/0234010 A1 8/2017 Klein
2017/0260741 A1 9/2017 Ackerman et al.
2017/0306615 A1 10/2017 Klein et al.
2018/0010333 A1 1/2018 Förg
2018/0044913 A1 2/2018 Klein et al.
2018/0072922 A1 3/2018 Canale
2018/0171624 A1 6/2018 Klein et al.
2018/0171646 A1* 6/2018 Stahl ..... E04F 21/0053
2018/0195282 A1 7/2018 Pilz
2019/0284799 A1 9/2019 Förg
2019/0316350 A1 10/2019 Pilz et al.
2019/0323234 A1 10/2019 Watanabe et al.

(56) References Cited

U.S. PATENT DOCUMENTS

| | | | |
|---|---|---|---|
| 2019/0323347 | A1 | 10/2019 | Hensley et al. |
| 2020/0056073 | A1 | 2/2020 | Hulteen et al. |
| 2020/0080666 | A1 | 3/2020 | Rakic |
| 2020/0199867 | A1 | 6/2020 | Ackerman et al. |
| 2020/0240140 | A1 | 7/2020 | Pilz |
| 2020/0308829 | A1 | 10/2020 | Hunsaker |
| 2020/0340239 | A1 | 10/2020 | Chang |
| 2020/0347590 | A1 | 11/2020 | Robinson |
| 2020/0362551 | A1 | 11/2020 | Klein et al. |
| 2021/0010257 | A1 | 1/2021 | Klein et al. |
| 2021/0017761 | A1 | 1/2021 | Klein et al. |
| 2021/0032927 | A1 | 2/2021 | Brown |
| 2021/0040731 | A1 | 2/2021 | Pilz |
| 2021/0062502 | A1 | 3/2021 | Archer et al. |
| 2021/0101319 | A1 | 4/2021 | Klein et al. |
| 2021/0148112 | A1 | 5/2021 | Klein |
| 2021/0164222 | A1 | 6/2021 | Pilz |
| 2021/0189721 | A1 | 6/2021 | Klein et al. |
| 2021/0285208 | A1 | 9/2021 | Pilz |
| 2022/0023684 | A1 | 1/2022 | Pilz et al. |
| 2022/0042303 | A1 | 2/2022 | Pilz |
| 2022/0056686 | A1 | 2/2022 | Pilz |
| 2022/0098856 | A1 | 3/2022 | Pilz |
| 2022/0106785 | A1 | 4/2022 | Klein |
| 2022/0154456 | A1 | 5/2022 | Griffith et al. |
| 2022/0162851 | A1 | 5/2022 | Pilz |
| 2022/0259852 | A1 | 8/2022 | Pilz |
| 2022/0268017 | A1 | 8/2022 | Pilz |
| 2022/0349177 | A1 | 11/2022 | Pilz |
| 2022/0401767 | A1 | 12/2022 | Pilz |
| 2023/0115315 | A1 | 4/2023 | Pilz et al. |
| 2023/0203807 | A1 | 6/2023 | Pilz et al. |
| 2023/0407626 | A1 | 12/2023 | Pilz et al. |
| 2024/0052629 | A1 | 2/2024 | Pilz et al. |
| 2024/0125115 | A1 | 4/2024 | Pilz et al. |
| 2024/0167269 | A1 | 5/2024 | Pilz et al. |
| 2024/0189636 | A1 | 6/2024 | Pilz et al. |
| 2024/0207661 | A1 | 6/2024 | Pilz et al. |
| 2024/0209623 | A1 | 6/2024 | Pilz |
| 2024/0218657 | A1 | 7/2024 | Pilz |
| 2024/0240456 | A1 | 7/2024 | Pilz |
| 2024/0263441 | A1 | 8/2024 | Pilz |
| 2024/0263444 | A1 | 8/2024 | Pilz et al. |

FOREIGN PATENT DOCUMENTS

| | | | |
|---|---|---|---|
| CA | 2711659 | | 2/2012 |
| CA | 2803439 | | 3/2017 |
| DE | 2645807 | B1 | 3/1978 |
| DE | 60213279 | T2 | 7/2007 |
| EP | 0 335 347 | | 10/1989 |
| EP | 0 346 126 | | 12/1989 |
| EP | 0509701 | A1 | 10/1992 |
| EP | 2942193 | A1 | 11/2015 |
| EP | 3 196 376 | | 7/2017 |
| EP | 3 348 729 | | 7/2018 |
| EP | 3 556 957 | A1 | 10/2019 |
| EP | 3584381 | A1 | 12/2019 |
| GB | 2 159 051 | | 11/1985 |
| GB | 2 239 213 | A | 6/1991 |
| GB | 2 411 212 | | 8/2005 |
| GB | 2 424 658 | | 10/2006 |
| GB | 2 494 721 | A | 3/2013 |
| JP | H06-042090 | A | 2/1994 |
| JP | H06-146433 | | 5/1994 |
| JP | H06-220934 | | 8/1994 |
| JP | H07-004620 | U | 1/1995 |
| KR | 100664665 | B1 | 1/2007 |
| KR | 20190068167 | A | 6/2019 |
| WO | WO 2003/038206 | | 5/2003 |
| WO | WO 2004/071584 | | 8/2004 |
| WO | WO 2007/103331 | | 9/2007 |
| WO | WO 2013/113734 | | 8/2013 |
| WO | WO 2017/129398 | | 1/2017 |
| WO | WO 2019/108295 | | 6/2019 |

OTHER PUBLICATIONS

Catalog page from Stockton Products, printed from www.stocktonproducts.com, on Dec. 16, 2007, showing #5 Drip, in 1 page.

ClarkDietrich Building Systems, Product Submittal Sheet, (FTSC) Flat Trail Vertical Slide Clip. CD-FTSC11 Jul. 2011. 1 page.

Double TrackTM information sheets by Dietrich Metal Framing, in 2 pages; accessible on Internet Wayback Machine on Jul. 8, 2006.

FireStikTM by CEMCO Brochure, published on www.firestik.us, in 18 pages; accessible on Internet Wayback Machine on Aug. 13, 2007.

Information Disclosure Statement letter; U.S. Appl. No. 12/196,115, dated Aug. 4, 2011.

"Intumescent Expansion Joint Seals", Astroflame; http://www.astroflame.com/intumescent_expansion_joint_seals; Jul. 2011; 4 pages.

James A. Klein's Answer, Affirmative Defenses and Counterclaims to Third Amended Complaint; U.S. District Court, Central District of California; Case No. 2:12-cv-10791-DDP-MRWx; Filed Sep. 17, 2014; pp. 1-37.

Letter from Thomas E. Loop; counsel for defendant; Jun. 26, 2015.

Expert Report of James William Jones and exhibits; Case No. CV12-10791 DDP (MRWx); May 18, 2015.

Letter from Ann G. Schoen of Frost Brown Todd, LLC; Jun. 24, 2015.

"System No. HW-D-0607", May 6, 2010, Metacaulk, www.rectorseal.com, www.metacaulk.com; 2008 Underwriters Laboratories Inc.; 2 pages.

Trim-Tex, Inc., TRIM-TEX Wall Mounted Deflection Bead Installation Instructions, 2 pages.

"Wall Mounted Deflection Bead," Trim-Tex Drywall Products; Oct. 9, 2016; 3 pages.

* cited by examiner

FIRE OR SOUND BLOCKING COMPONENTS AND WALL ASSEMBLIES WITH FIRE OR SOUND BLOCKING COMPONENTS

CROSS-REFERENCE TO RELATED APPLICATIONS

This application is a continuation of U.S. patent application Ser. No. 17/446,947, filed Sep. 3, 2021, which is a continuation of U.S. patent application Ser. No. 16/541,951, now U.S. Pat. No. 11,111,666, filed Aug. 15, 2019, which claims benefit of U.S. Provisional Patent Application No. 62/764,883 filed Aug. 16, 2018, U.S. Provisional Patent Application No. 62/775,801 filed Dec. 5, 2018, U.S. Provisional Patent Application No. 62/780,059, filed Dec. 14, 2018, and U.S. Provisional Patent Application No. 62/870,933, filed Jul. 5, 2019. The entire disclosure of each of the above items is hereby made part of this specification as if set forth fully herein and incorporated by reference for all purposes, for all that it contains.

BACKGROUND

Field

The present disclosure relates to fire-resistant or sound-resistant building structures. In particular, the present disclosure relates to a fire or sound blocking wall assemblies and related components.

Description of Related Art

Fire-rated or sound-rated construction components and assemblies are commonly used in the construction industry. These components and assemblies are aimed at inhibiting or preventing fire, heat, smoke or sound from leaving one room or other portion of a building and entering another room or portion of a building. The fire, heat, smoke or sound usually moves between rooms through vents, joints in walls, or other openings. The fire-rated components often incorporate fire-retardant materials that substantially block the path of the fire, heat or smoke for at least some period of time. Intumescent materials work well for this purpose, because they swell and char when exposed to flames helping to create a barrier to the fire, heat, and/or smoke. Similarly, sound-rated components block sound from moving between rooms.

A wall assembly commonly used in the construction industry includes a header track, bottom track, a plurality of wall studs and a plurality of wall board members, possibly among other components. A typical header track resembles a generally U-shaped (or some other similarly shaped) elongated channel capable of receiving or covering the ends of wall studs and holding the wall studs in place. The header track also permits the wall assembly to be coupled to an upper horizontal support structure, such as a ceiling or floor of a higher level floor of a multi-level building.

One particular wall joint with a high potential for allowing fire, heat, smoke or sound to pass from one room to another is the joint between the top of a wall and the ceiling, which can be referred to as a head-of-wall joint. In modern multi-story or multi-level buildings, the head-of-wall joint is often a dynamic joint in which relative movement between the ceiling and the wall is permitted. This relative movement is configured to accommodate deflection in the building due to loading of the ceiling or seismic forces. One conventional method for creating a fire-rated head-of-wall joint is to stuff a fire-resistant mineral wool material into the head-of-wall joint and then spray an elastomeric material over the joint to retain the mineral wool in place. This conventional construction of a fire-rated head-of-wall joint is time-consuming, expensive and has other disadvantages.

Another feature that requires fire protection is an aesthetic reveal feature within or along an edge of a wall. A reveal is a gap within or along a top, bottom or side edge of the wall. Conventionally, the reveal is created by using an additional cosmetic layer of wall board over top of one or more underlying layers of wall board. The underlying layer(s) provide the desired fire rating to the wall—including to the reveal gap. However, this method of creating a cosmetic reveal requires nearly an entire extra layer of wall board material.

SUMMARY

The systems, methods and devices described herein have innovative aspects, no single one of which is indispensable or solely responsible for their desirable attributes. Without limiting the scope of the claims, some of the advantageous features will now be summarized.

An aspect of the present disclosure involves a fire-blocking element including a profile. The profile has a first leg and a second leg. The first leg and the second leg are arranged to form a generally L-shaped structure in cross-section. The first leg is configured to extend along an upper edge of an outward-facing surface of wall board of a wall in use. The second leg is configured to extend along the end surface of the wall board in use. The first leg comprises an array of openings configured to receive joint compound. A gasket element is configured to contact an overhead structure associated with the wall in use. The gasket element is compressible to conform to an irregular surface of the overhead structure. A fire-blocking material strip is located on the second leg of the profile. The fire-blocking material strip is located on an opposite side of the gasket element relative to the first leg.

In some configurations, the gasket element is a bubble gasket having a wall that defines an interior space.

In some configurations, the bubble gasket is hollow.

In some configurations, the bubble gasket comprises multi layers of vinyl and/or foil tape to restrict the passage of heat.

In some configurations, the fire-blocking material strip is an intumescent material.

In some configurations, a portion of the fire-blocking strip extends beyond a free edge of the second leg.

In some configurations, the fire-blocking strip is located on the interior or exterior side of the second leg.

In some configurations, a free edge of the second leg defines an upturned kickout configured to flex relative to a remainder of the second leg.

In some configurations, a wall assembly includes any of the fire-blocking elements described above.

An aspect of the present disclosure involves an elongate fire-blocking element including a first leg and a second leg. The first leg and the second leg are arranged to form a generally L-shaped structure in cross-section. The first leg is configured to extend along an outward-facing surface of a wall component of a wall between the wall component and a wall board of the wall in use. The second leg is configured to be positioned between the wall component of the wall and an overhead structure in use. A gasket element is configured to contact the overhead structure in use. The gasket element is compressible to conform to an irregular surface of the overhead structure. A protruding rib is located on an interior surface of the first leg and extending in a lengthwise direction of the elongate fire-blocking element. The protruding rib is configured to contact the wall component. The protruding rib is spaced from a free end of the first leg to create a space between a lower portion of the first leg and the wall component in use.

In some configurations, at least the first leg, the second leg and the protruding rib are formed as a unitary structure.

In some configurations, the unitary structure is made from vinyl, plastic, rubber or a combination thereof.

In some configurations, the second leg is shorter than the first leg.

In some configurations, the second leg is tapered increasing in thickness in a direction from a free end toward a corner between the first leg and the second leg such that the second leg can be friction fit between the wall component and the overhead structure.

In some configurations, the gasket element is a bubble gasket having a wall that defines an interior space.

In some configurations, a wall assembly includes any of the elongate fire-blocking elements described above.

In some configurations, the wall component is a slotted header track and the protruding rib is located above the slots of the slotted header track.

An aspect of the present disclosure involves a fire-blocking element including a profile comprising a first leg and a second leg arranged to form a generally L-shaped structure when viewed from the end or in cross-section. The first leg is configured to extend along an upper edge of an outward-facing or exposed surface of wall board of a wall in use. The second leg is configured to extend along the return of the free open edge of the wall board in use. The first leg is covered by joint compound and may include features that facilitate the use of joint compound. A gasket element is disposed on an exterior surface of the second leg and is configured to contact a ceiling or other overhead structure associated with the wall. The wall of the gasket element is compressible so that the gasket element can conform to the ceiling or other overhead structure. A free edge of the second leg defines an upturned kickout configured to flex relative to a remainder of the second leg.

In some configurations, the free edge is configured to contact a header track of the wall assembly.

In some configurations, a fire-blocking material strip is located on the second leg.

In some configurations, the first leg, the second leg and the gasket element are formed as a unitary structure.

An aspect of the present disclosure involves a fire-rated wall assembly with an architectural reveal including a first wall board member having a first wall board surface and a first end surface and a second wall board member having a second wall board surface and a second end surface. The first end surface and the second end surface face each other and define a reveal gap therebetween. A fire-block wall component includes a first layer and a fire-resistant material attached to the first layer. The fire-resistant material strip is an intumescent material that expands in response to heat. The first layer includes a central portion and a pair of flanges extending therefrom in opposite directions. The central portion includes a first side panel, a second side panel, and a central panel. The central panel being generally orthogonal with respect to the first and second side panels. The fire-resistant material is attached on exterior surfaces of the first and second side panels and the fire-block wall component is installed within the reveal gap with the fire-resistant material facing the first and second end surfaces of the first and second wall board members. The pair of flanges are attached to the first and second wall board surfaces.

In some configurations, the central portion defines a width between the first and second side panels, the width being between ¼ and 3 inches.

In some configurations, the central portion defines a rectangular cross-sectional shape.

In some configurations, the intumescent material is configured to expand across the deflection gap in a perpendicular direction relative to the first and second end surfaces of the first and second wall board members.

An aspect of the present disclosure involves a fire-rated wall assembly with an architectural reveal including a wall board member having an outer surface and an end surface. The wall board member at least partially defines a reveal gap. A Z-shaped fire-block wall component includes a first layer that is Z-shaped. The first layer has a reveal leg, a central leg, and an attachment leg. A fire-resistant material is attached to the central leg. The Z-shaped fire-block wall component is installed with the fire-resistant material located between the central leg and the end surface of the wall board. The reveal leg is located within the reveal gap. The perforated leg is attached to the outer surface of the wall board member.

In some configurations, the central portion defines a width between the first and second side panels, the width being between ¼ and 3 inches.

In some configurations, the central portion defines a rectangular cross-sectional shape.

In some configurations, the fire-resistant material is an intumescent material configured to expand across the reveal gap in a perpendicular direction relative to the end surface of the wall board member.

In some configurations, the wall board member cooperates with another wall board member, an overhead structure or a floor to define the reveal gap.

BRIEF DESCRIPTION OF THE DRAWINGS

The foregoing and other features of the present disclosure will become more fully apparent from the following description and appended claims, taken in conjunction with the accompanying drawings. Understanding that these drawings depict only several embodiments in accordance with the disclosure and are not to be considered limiting of its scope, the disclosure will be described with additional specificity and detail through the use of the accompanying drawings.

DETAILED DESCRIPTION

Figure 1:
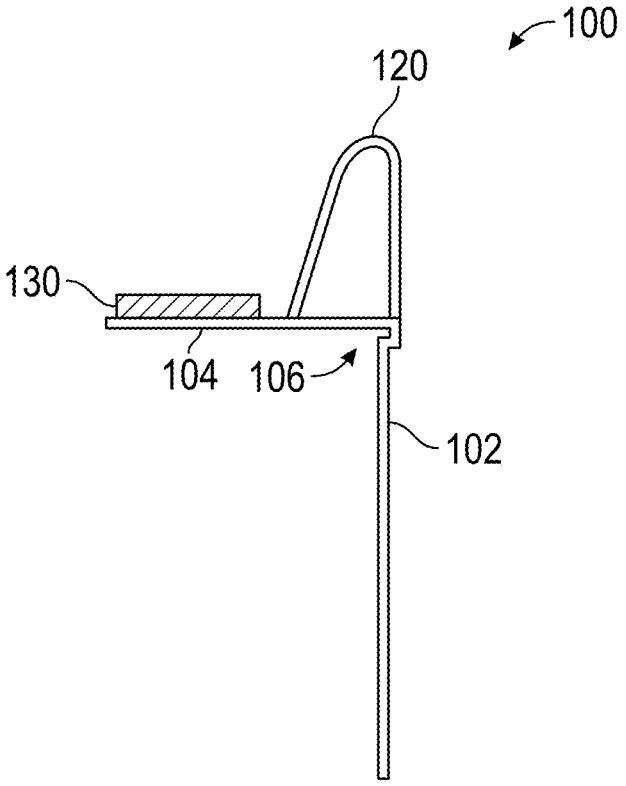
FIG. 1 is an end view of an elongate fire-blocking bead element.

Embodiments of systems, components and methods of assembly and manufacture will now be described with reference to the accompanying figures, wherein like numerals refer to like or similar elements throughout. Although several embodiments, examples and illustrations are disclosed below, it will be understood by those of ordinary skill in the art that the inventions described herein extends beyond the specifically disclosed embodiments, examples and illustrations, and can include other uses of the inventions and obvious modifications and equivalents thereof. The terminology used in the description presented herein is not intended to be interpreted in any limited or restrictive manner simply because it is being used in conjunction with a detailed description of certain specific embodiments of the inventions. In addition, embodiments of the inventions can comprise several novel features and no single feature is solely responsible for its desirable attributes or is essential to practicing the inventions herein described.

Certain terminology may be used in the following description for the purpose of reference only, and thus are not intended to be limiting. For example, terms such as "above" and "below" refer to directions in the drawings to which reference is made. Terms such as "front," "back," "left," "right," "rear," and "side" describe the orientation and/or location of portions of the components or elements within a consistent but arbitrary frame of reference which is made clear by reference to the text and the associated drawings describing the components or elements under discussion. Moreover, terms such as "first," "second," "third," and so on may be used to describe separate components. Such terminology may include the words specifically mentioned above, derivatives thereof, and words of similar import.

Fire-Blocking Component and Related Wall Assemblies

An aspect of the present disclosure relates to a component, which can be referred to as a fire-blocking bead. In some configurations, the component can have at least a first leg and a second leg arranged to form a generally L-shaped structure when viewed from the end or in cross-section. The first leg is configured to extend along an upper edge of an outward-facing or exposed surface of wall board of a wall in use. The second leg is configured to extend along an upper end surface of the wall board in use. In a finished wall assembly, the first leg can be covered by joint compound and may include features (e.g., an array of openings) that facilitate attachment to the wall board and/or the use of joint compound. The component may also include a gasket element configured to contact and/or create a seal with a ceiling or other overhead structure associated with the wall. In some configurations, the gasket element is a bubble gasket having a wall that defines an interior air space. The wall of the bubble gasket can be compressible so that the bubble gasket can conform to the ceiling or other overhead structure. The bubble gasket can be hollow (e.g., filled with atmospheric air or another gas, which can be pressurized or not). The bubble gasket can be located on the second leg. The bubble gasket can be located at or near a corner or transition between the first leg and the second leg. The bead element can also include a fire-blocking material. In some configurations, the fire-blocking material is located on the second leg. The bubble gasket can be located between the fire-blocking material and the corner or the first leg. In some configurations, the fire-blocking material is located at or near a free end portion of the second leg. The bubble gasket can be set back from the corner to create a recessed reveal along the second leg. One or both of the fire-blocking material and the bubble gasket can be located on an upward-facing or outward-facing surface of the bead element. The fire-blocking material can be an intumescent material, such as an intumescent material strip or intumescent foam. Intumescent materials expand under exposure to elevated temperatures, but expansion alone may not provide a proper seal against fire, and smoke. It can be important to effectively contain the expanded intumescent material within the head of wall joint so that it does not expand in a manner that will allow it to fall out of the joint. Another aspect of the present disclosure is a wall assembly incorporating one or more of the above-described fire-blocking bead elements.

FIG. 1 illustrates a fire-blocking bead element or component 100. The bead element 100 can be constructed in whole or in part from a suitable polymer material, such as a vinyl. The illustrated bead element 100 includes a first leg 102 and a second leg 104 arranged to form a generally L-shaped profile structure 106 when viewed from the end or in cross-section. In the illustrated arrangement the first leg 102 is slightly set back from an attached edge of the second leg 104 to create a space to receive joint compound such that an outer surface of the joint compound ends up flush with the outer or attached edge of the second leg 104. In other arrangements, the profile 106 can include additional legs or portions.

Figure 2:
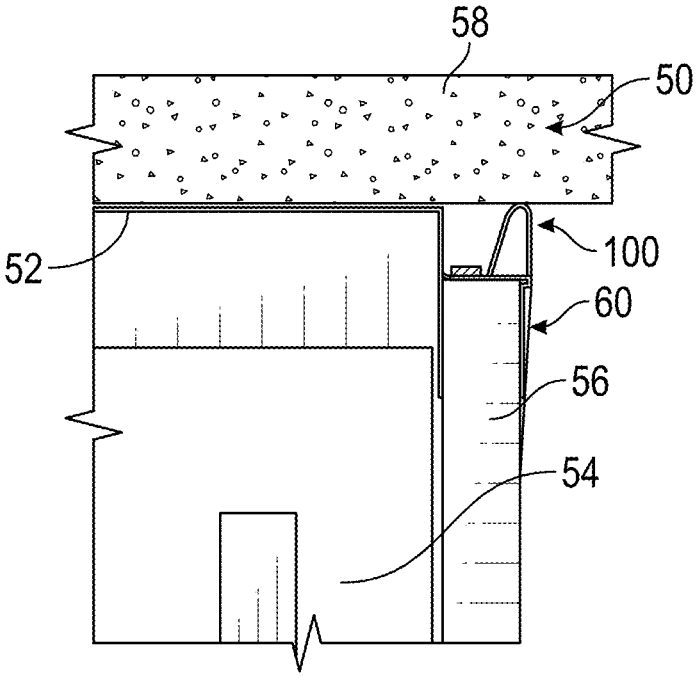
FIG. 2 is a sectional view of a wall assembly incorporating the fire-blocking bead element of FIG. 1.

FIG. 2 illustrates the bead element 100 incorporated into a wall assembly 50 having a head-of-wall arrangement. The illustrated wall assembly 50 is an interior wall of a well-known stud wall arrangement having a dynamic head-of-wall. The wall assembly 50 includes a bottom track (not shown), a header track 52, and a plurality of studs 54 that extend between and have ends attached to the bottom track and the header track 52. One or more pieces of wall board 56 (e.g., gypsum board or drywall) is attached to the studs 54 and bottom track so that the wall board 56, studs 54 and bottom track are free to move relative to the header track 52 and an overhead structure 58 to which the header track 52 is attached. The overhead structure 58 can be a ceiling or a floor of a higher-level floor of a multi-story building.

The first leg 102 of the component 100 is configured to extend along an upper edge of an outward-facing or exposed surface of the wall board 56 in use, as shown in FIG. 2. The second leg 104 is configured to extend along an upper end surface of the wall board 56 in use, as shown in FIG. 2. In a finished wall assembly 50, the first leg 102 can be covered by joint compound 60 and may include features (e.g., an array of openings) that facilitate attachment of the component 100 to the wall board 56 and/or the use of the joint compound 60.

In some configurations, the bead element 100 can also include a gasket portion or gasket element 120 configured to contact and/or create a seal with the ceiling 58 or other overhead structure associated with the wall 50, as shown in FIG. 2. In some configurations, the gasket element is in the form of a bubble gasket 120, which has a wall that defines an interior space. The wall of the bubble gasket 120 can be compressible so that the bubble gasket 120 can conform to the ceiling 58 or other overhead structure. That is, the bubble gasket 120 preferably conforms to irregularities in the ceiling 58 or other overhead structure to maintain a seal with the ceiling 58. In addition, the bubble gasket 120 is configured to accommodate relative movement between the wall 50 and the ceiling 58 that causes variations in the size of the deflection gap. Preferably, the bubble gasket 120 is configured to maintain a seal or at least a substantial seal with the ceiling 58 despite relative movement between the wall 50 and the ceiling 58.

The bubble gasket 120 can be hollow (e.g., filled with atmospheric air or another gas, which can be pressurized or not) or filled with a non-gas substance (e.g., compressible foam). In the illustrated arrangement, the bubble gasket 120 is unitarily-formed with the first leg 102 and/or the second leg 104. In other arrangements, the bubble gasket 120 can be formed separately from the first leg 102 and/or the second leg 104 and affixed thereto. In some configurations, the bubble gasket 120 is co-extruded with the first leg 102 and the second leg 104. The bubble gasket 120 can be the same or a different material from the first leg 102 and/or the second leg 104. In some configurations, the first leg 102 and the second leg 104 are constructed from a vinyl material, or a similar material. The bubble gasket 120 can be constructed of a vinyl material or can be another suitable material, such as an elastomeric or rubber-like material. The bubble gasket 120 can have a different wall thickness (e.g., smaller or larger wall thickness) than one or both of the first leg 102 and/or the second leg 104. Any one or combination of the first leg 102, the second leg 104, and the bubble gasket 120 could also have multiple layers, which can include a vinyl (or similar) layer and a foil (or similar, preferably metal or metalized) layer (e.g., foil tape).

The bubble gasket 120 can be located only on the second leg 104. The bubble gasket 120 can be located at or near a corner or transition between the first leg 102 and the second leg 104. In such configurations, a portion of the bubble gasket 120 can be aligned with or substantially aligned with the first leg 102. As used herein, the bubble gasket 120 being substantially aligned with the first leg 102 means that the relevant portion of the bubble gasket 120 is configured to be aligned with a surface of the joint compound 60 in an installed configuration. In some arrangements, the bubble gasket 120 includes a planar or substantially planar wall that faces outwardly as installed. However, other cross-sectional shapes of the bubble gasket 120 are also possible. Furthermore, in other arrangements, the bubble gasket 120 can be set back along the second leg 104 such that it is spaced rearwardly or inwardly from an exposed surface of the wall board 56 and/or joint compound 60.

The bead element 100 can also include a fire-blocking material 130. In some configurations, the fire-blocking material 130 is located on the second leg 104. The second leg 104 can have a portion located inward (relative to an exposed surface of the wall 50) of the bubble gasket 120 on which the fire-blocking material 130 is located. In other words, the bubble gasket 120 can be located between the fire-blocking material 130 and the corner or the first leg 102. In some configurations, the fire-blocking material 130 is located at or near a free end portion of the second leg 104. One or both of the fire-blocking material 130 and the bubble gasket 120 can be located on an upward-facing or outward-facing surface of the bead element 100. The fire-blocking material 130 can be an intumescent material, such as an intumescent material adhesive strip, an intumescent paint or an intumescent foam. As is known, an intumescent material expands in response to elevated temperature to create a fire-blocking char.

As used herein, a fire-blocking material, component or arrangement provides greater fire-blocking properties than some or all of the surrounding building materials, such as the wall board 56, for example. A fire-blocking material, component or arrangement preferably permits the associated structure to achieve a fire rating by passing relevant fire tests, such as but not limited to relevant UL fire tests or other relevant fire rating tests or standards (e.g., UL-2079). Similarly, a sound blocking material, component or arrangement provides greater sounding blocking properties than the surrounding building materials or than conventional arrangements. A sound blocking material preferably permits the associated structure to achieve a sound rating (e.g., Sound Transmission Class (STC) ratings) that is higher than a standard metal stud wall assembly. Fire-blocking or sound blocking is not intended to require the prevention of heat, smoke, fire or sound passage across the wall.

The illustrated bead element 100 is well-suited for use in a wall assembly having a single layer of wall board 56. The bead element 100 can be elongate and have a consistent cross-sectional shape throughout its length. The length can be selected to provide a compromise between case of manufacture/storage/shipping and wall length coverage in use. Suitable lengths can be between about 8 feet and about 16 feet, for example and without limitation. In some configurations, a width of the bubble gasket 120 and a width of the intumescent material 130 (or a portion of the second leg 104 located inward of the bubble gasket 120) can be equal or substantially equal (e.g., about one-quarter or five-sixteenths inch). In wall assemblies having additional layers of wall board 56, a width (or cross-sectional length) of the second leg 104 may be increased. In some configurations, the width (or cross-sectional length) of the second leg 104 can be approximately equal to the total thickness of the wall board 58. In such arrangements, the width of the bubble gasket 120 and the width of the intumescent material 130 can be the same as one another and/or the same as in the bead element 100 configured for a single layer of wall board 56. Alternatively, a width of one or both of the bubble gasket 120 and the intumescent material 130 can be increased. A height of the bubble gasket 120 can be equal to or slightly greater than a desired maximum deflection gap of the associated wall assembly 50. In some cases, the height of the bubble gasket 120 can be between about one-half inch to about one inch.

Figure 3:
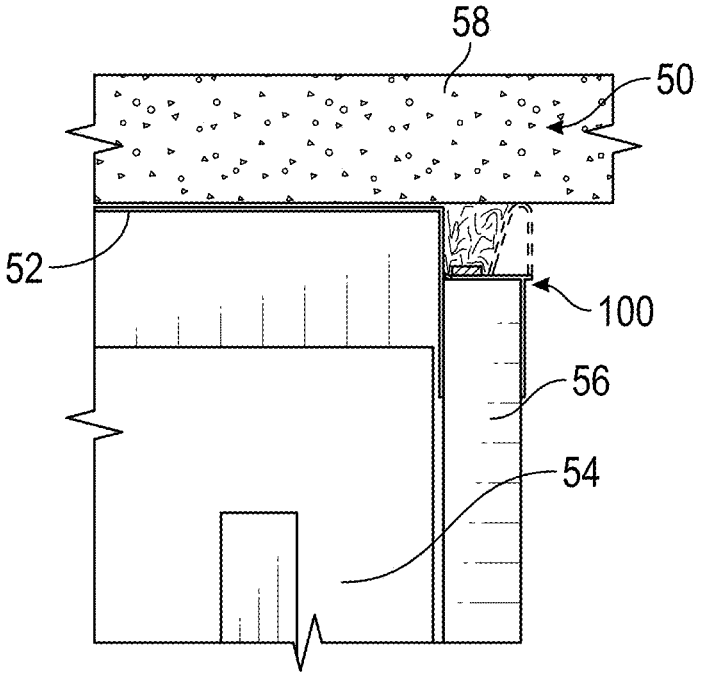
FIG. 3 is the sectional view of the wall assembly of FIG. 2 illustrating a profile portion of the bead element melting away and an intumescent material portion expanding.

FIG. 3 illustrates the bead element 100 in the wall assembly 50 at an elevated temperature. The profile 106 portion and/or bubble gasket 120 of the bead element 100 are illustrated in dashed line indicating that they are starting to melt away. The intumescent strip 130 is illustrated as expanding. Preferably, expansion of the intumescent strip 130 begins before one or both of the profile 106 portion and the bubble gasket 120 fully melt or dissipate.

Figure 4A:
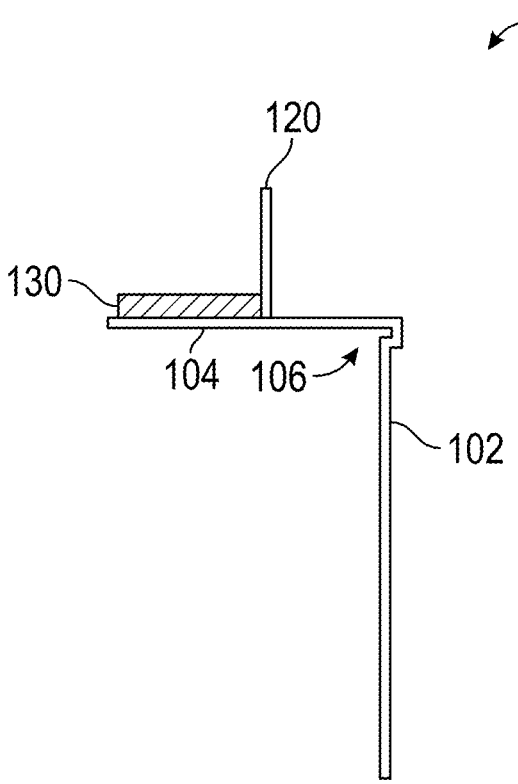
FIG. 4*a* illustrates a first alternative profile shape for a fire-blocking bead element.
Figure 4B:
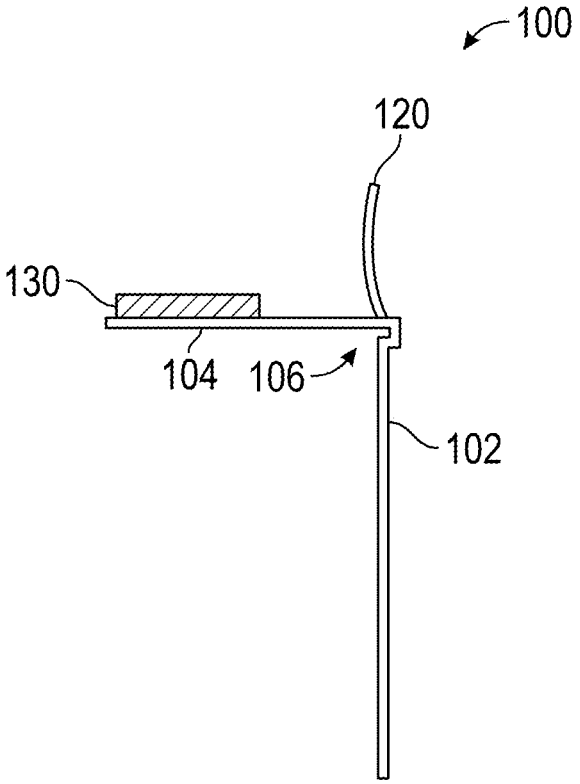
FIG. 4*b* illustrates a second alternative profile shape for a fire-blocking bead element.

FIGS. 4*a* and 4*b* illustrates additional embodiments of the bead element 100. These bead elements 100 may be similar in many respects to the bead elements described above and are described below with an emphasis on the differences relative to the previously-described bead elements. Therefore, features that are not described below can be the same as or similar to the corresponding features of the other embodiments described herein, or can be of another suitable arrangement.

With respect to FIG. 4*a*, an outermost portion of the gasket element 120 is set back from the corner or the outer edge of the second leg 104. Such an arrangement provides a space or reveal above the upper end of the wall board 56 (FIG. 2). In the illustrated arrangement, the gasket element 120 is a single wall construction having an edge (or end in cross-section) connected to the second leg 104 and a free edge (or end). The gasket element 120 is planar or substantially planar and is oriented perpendicular or substantially perpendicular to the second leg 104. However, in other arrangements, the gasket element 120 could have multiple walls or wall portions that connect to the profile 106 at two or more locations to define an enclosed interior space.

FIG. 4*b* illustrated a bead element 100 having a slightly curved single wall gasket element 120. In the illustrated arrangement, the gasket element 120 is located at or near the corner between the first leg 102 and the second leg 104 or at the outer edge of the second leg 104. Accordingly, the gasket element 120 can be align with or substantially aligned with the first leg 102. The gasket element 120 is oriented perpendicular or substantially perpendicular to the second leg 104. In other arrangements, the gasket element 120 could be set back along the second leg 104 and/or could have multiple walls or wall portions that connect to the profile 106 at two or more locations to define an enclosed interior space.

Figure 5:
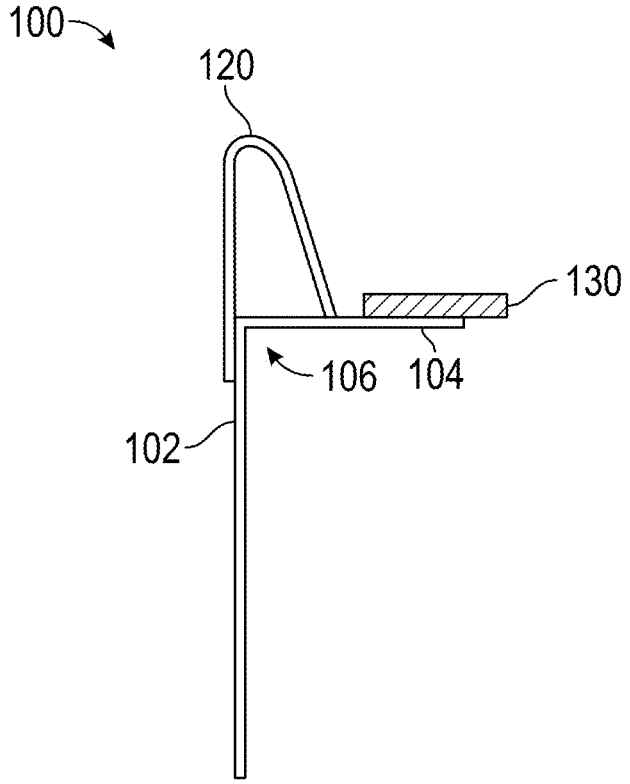
FIG. 5 is an end view of an elongate fire-blocking element having a gasket and a fire-resistant material supported by a profile in the form of an angle.
Figure 6:
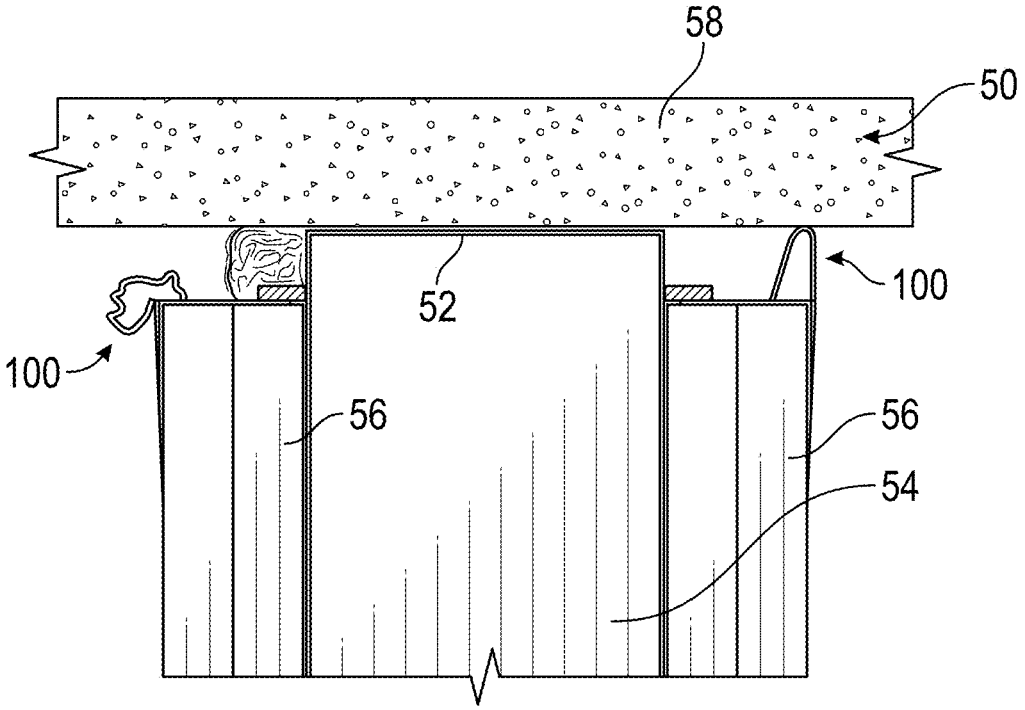
FIG. 6 is a sectional view of a wall assembly incorporating the fire-blocking element of FIG. 5.

FIGS. 5 and 6 illustrate another fire-blocking bead element 100 and a wall assembly 50 incorporating the bead element 100. The bead element 100 is similar in many respects to the bead elements described above and is described below with an emphasis on the differences relative to the previously-described bead elements. Therefore, features that are not described below can be the same as or similar to the corresponding features of the other embodiments described herein, or can be of another suitable arrangement.

The bead element 100 of FIGS. 5 and 6 includes a first leg 102 and a second leg 104 that cooperate to form a profile 106. In the illustrated arrangement, the profile 106 is in the form of an angle 106 and is made up in whole or a substantial entirety by the first leg 102 and the second leg 104. However, in other arrangements, the profile 106 can include additional legs or portions. In the illustrated arrangement, the first leg 102 and the second leg 104 are oriented perpendicular or substantially perpendicular to one another.

The bead element 100 includes a gasket element 120, which can be in the form of a bubble gasket 120 such as those described herein. The bubble gasket 120 extends upwardly from an upper surface of the second leg 104 with the bead element 100 oriented as employed in a head-of-wall gap. In the illustrated arrangement, the bubble gasket 120 is located at or adjacent a corner defined between the first leg 102 and the second leg 104. The illustrated bubble gasket 120 has one end connected to the first leg 102 and one end connected to the second leg 104. However, in some arrangements, both ends can be connected to a single one of the first leg 102 and the second leg 104.

In the illustrated arrangement, the bubble gasket 120 includes a planar or substantially planar portion, which can be arranged to be in the same plane as or parallel to the first leg 102. That is, the planar portion can be aligned with or substantially aligned with the first leg 102. Such an arrangement can provide an attractive finished appearance to the head-of-wall gap without the need for additional finishing elements or substances. Alternatively, the bubble gasket 120 can have other suitable shapes, such as square, round or oval. The profile 106, including the bubble gasket 120, can be constructed from any suitable material, such as vinyl, PVC, rubber or rubber-like (e.g., elastomeric) materials. The bubble gasket 120 can be formed separately from the profile 106 and secured thereto or can be formed as a unitary structure. In some cases, the bubble gasket 120 is co-extruded with the profile 106. Such an arrangement avoids the need to separately secure a sealing element to the profile.

In some configurations, the bead element 100 is used to seal a head-of-wall gap and does not provide a fire rating. However, the illustrated bead element 100 includes a fire-resistant material in the form of a material strip 130. The material strip 130 is elongate and has a width that is the same as or greater than a thickness of the strip 130. In some configurations, the fire-resistant material is an intumescent material or other similar material that expands in response to elevated temperatures to create a fire-block (e.g., a fire-blocking char). The intumescent material strip 130 projects beyond a free edge of the leg on which it is secured.

In the illustrated arrangement, the intumescent material strip 130 is secured to the second leg 104 and at least a portion of the intumescent material strip 130 extends beyond an edge of the second leg 104 such that the intumescent material strip 130 contacts the header track 52 or other component of the wall assembly 50 interior of the wall board 56, as illustrated in FIG. 6. Such an arrangement can advantageously create a seal or a substantial seal between the bead element 100 and the header track 52 or other wall structure. In some configurations, the intumescent material strip 130 can contact the header track 52 above any stud-attachment slots when used in connection with a slotted header track. In situations in which fire-blocking is not needed or desired, the intumescent material strip 130 can be replaced with a non-expanding or non-fire-blocking material that functions to create a seal and not a fire-block.

The bead element 100 can have dimensions suitable for the intended purpose. The bead element 100 of FIG. 5, for example, can have a width of one and one-quarter inches for each of the first leg 102 and the second leg 104 when configured for use with two layers of wall board 56. In other arrangements, the width of the second leg 104 can be adjusted for the number of layers of wall board 56 present in the wall assembly 50 (e.g., five-eighths inch or one and seven-eighths inches). A height of the bubble gasket 120 can be one-half inch and a width of the intumescent material strip 130 can be one-half inch.

FIG. 6 illustrates a wall assembly 50 incorporating a pair of the bead elements 100 of FIG. 5. The right side of the wall assembly 50 illustrates the bead element 100 in an installed orientation in the absence of and prior to an elevated temperature. The left side of the wall assembly 50 illustrates the bead element 100 at or after an elevated temperature with the intumescent material strip 130 expanding or expanded to at least partially or fully seal the head-of-wall gap. Under some circumstances, the bubble gasket 120 may melt or otherwise deteriorate or disintegrate. However, preferably, the intumescent material strip 130 has expanded to seal the head-of-wall gap prior to the complete deterioration or disintegration of the bubble gasket 120.

As noted above, the bubble gasket 120 can be left exposed in the finished wall assembly 50. As also described above, the first leg 102 of the profile 106 is typically covered by joint compound 60 during the finishing of the wall board 56. The bubble gasket 120 is capable of permitting movement of the wall studs 54 and wall board 56 relative to the header track 52 and ceiling 58. The bubble gasket 120 can collapse and recover in response to such movement that causes changes in the size of the head-of-wall gap over repeated cycles without cracking or other significant degradation. In contrast, other head-of-wall gap fire-blocking or scaling solutions require a sealant to be applied to the head-of-wall gap, which sealant can be prone to cracking and separating from the ceiling 58 or the wall board 56.

Another benefit of the disclosed arrangements is that the bead element 100 is well-suited to being exposed to a typical construction environment. For example, the integrated or unitary structure of the bead element 100 inhibits or prevents separation of the bubble gasket 120 from the profile 106. With some existing head-of-wall gap fire-blocking or sealing solutions, especially those utilizing fire sealant, the fire sealant can separate from the underlying support structure creating a separation crack that can allow the passages of smoke, heat or sound. Furthermore, the materials from which the bead element 100 is constructed are capable of exposure to moisture. Accordingly, the bead element 100 can be stored outdoors, while many other head-of-wall gap fire-blocking or sealing solutions, especially those utilizing foam sealing elements, must be stored indoors to avoid damage from exposure to moisture or ultraviolet rays.

Versions of the bead element 100 having a unitary structure can be manufactured at a lower cost than solutions requiring assembly of multiple components. The fire-blocking or intumescent material element 130 is concealed and protected by the bubble gasket 120 in use. The bubble gasket 120 can be painted, whereas solutions utilizing foam elements must be covered with joint tape and joint compound before painting is possible. Such arrangements are prone to cracking. The bubble gasket 120 can create an air barrier, whereas at least some foam elements can permit the passage of air. The bubble gasket 120 can also receive a printed UL or other certification indication for case of inspection. Foam elements are more difficult or impossible to mark in a legible manner.

Figure 7:
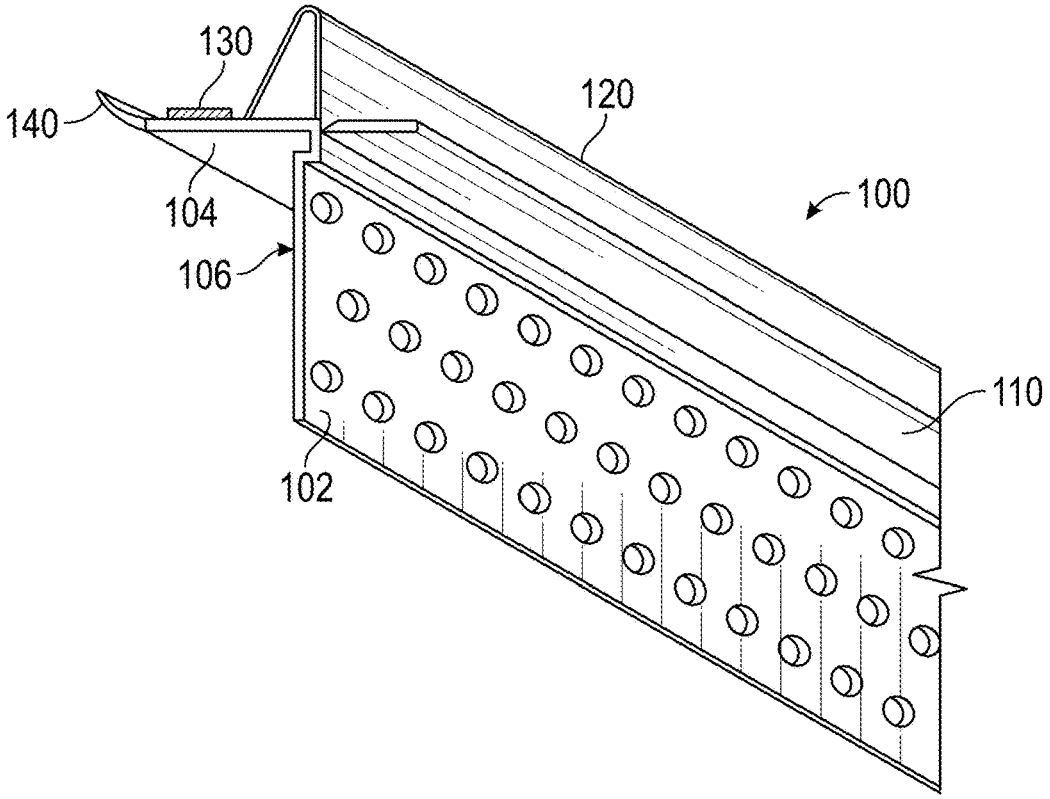
FIG. 7 is a perspective view of an elongate fire-blocking bead element having a gasket and a fire-resistant material supported by a profile in the form of an angle.
Figure 8:
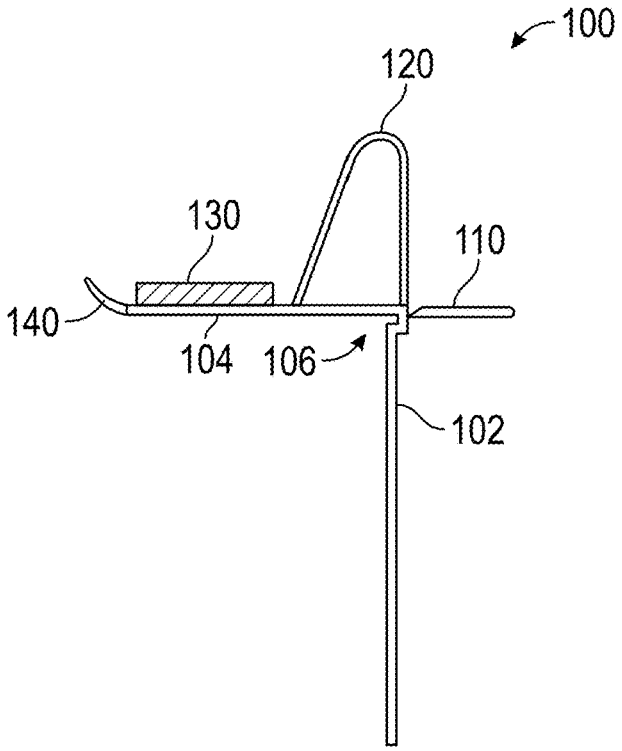
FIG. 8 is an end view of the fire-blocking bead element of FIG. 7.
Figure 9:
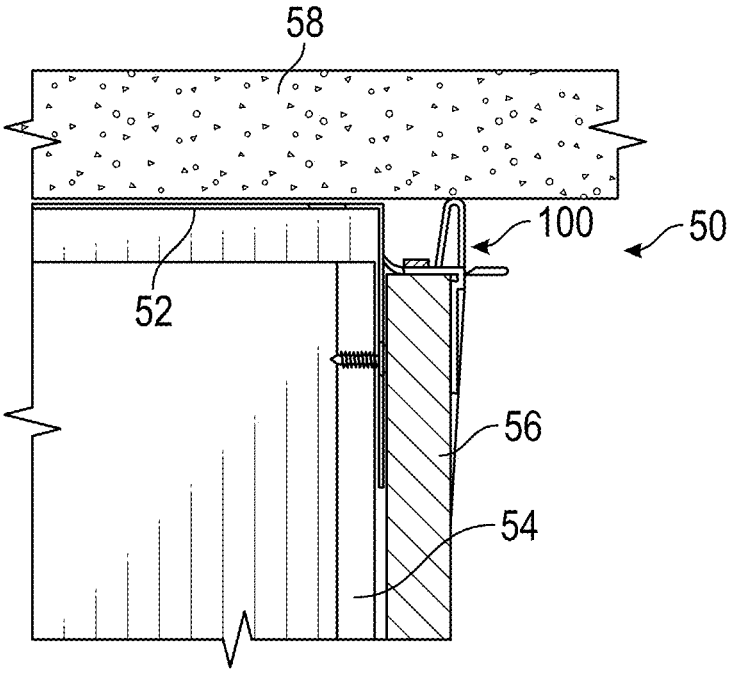
FIG. 9 is a sectional view of a wall assembly incorporating the fire-blocking bead element of FIGS. 7 and 8.

FIGS. 7-9 illustrate another fire-blocking bead element 100 and a wall assembly 50 incorporating the bead element 100. The bead element 100 is similar in many respects to the bead elements described above and is described below with an emphasis on the differences relative to the previously-described bead elements. Therefore, features that are not described below can be the same as or similar to the corresponding features of the other embodiments described herein, or can be of another suitable arrangement.

The bead element 100 includes a first leg 102 and a second leg 104 that cooperate to form a profile or angle 106. The bead element 100 also includes a gasket element or bubble gasket 120, which can be configured as discussed in connection with any embodiment herein. The bead element 100 also includes an internal seal structure 140. The internal seal structure 140 is configured to form a seal or at least a substantial seal with the header track 52 or other corresponding portion of the wall assembly 50 in a manner similar to the intumescent material strip 130 in the embodiment of FIGS. 5 and 6.

In the illustrated arrangement, the internal seal structure 140 is in the form of a kickout or bent end portion. The kickout 140 is curved and upturned in the illustrated embodiment. The kickout 140 extends from the second leg 104 upward or in a direction opposite that of the first leg 102. Preferably, the kickout 140 is flexible relative to the second leg 104. In some cases, a hinge arrangement may be provided to facilitate movement of the kickout 140 relative to the second leg 104. The hinge arrangement can comprise thinned material regions within or near the junction between the second leg 104 and the kickout 140. In other arrangements, a different wall thickness and/or different material can be used in the kickout 140 to create the greater relative flexibility compared to the first leg 102. In some configurations, the material of one or both of the bubble gasket 120 and the kickout 140 can have a 68-72 (e.g., 70) Shore A durometer.

As illustrated, the intumescent strip 130 can be located adjacent the kickout 140. In the illustrated arrangement, the intumescent strip 130 is located on an upper surface of the second leg 104 in between the kickout 140 and the bubble gasket 120. The intumescent strip 130 can be spaced from one or both of the kickout 140 and the bubble gasket 120.

The illustrated bead element 100 includes a tear off strip 110 that is co-planar with the second leg 104 and extends outwardly from the corner of the first leg 102 and the second leg 104 in a direction opposite the second leg 104. The tear off strip 110 is connected to the remainder of the profile 106 by a thin portion, which allows the tear off strip 110 to be easily removed by hand or with a hand tool, such as pliers. The tear off strip 110 inhibits or prevents joint compound from covering the bubble gasket 120 and/or entering the deflection gap. Once the joint compound has been applied, the tear off strip 110 can be removed.

The bead element 100 can have suitable dimensions for the desired application. The bead element 100 of FIGS. 7 and 8, for example, can have a width of one and one-eighth inches for the first leg 102 and one-half inch or one and one-eighth inches for the second leg 104 when configured for use with one or two layers of wall board 56 respectively. The kickout 140 can have a width or linear dimension in the plane of the second leg 104 of one-quarter inch. In other arrangements, the width of the second leg 104 can be adjusted for the number of layers of wall board 56 present in the wall assembly 50. A height of the bubble gasket 120 can be one-half inch. A width of the intumescent material strip 130 can be five-sixteenth inch and a thickness of the intumescent material strip 130 can be one and one-half millimeters.

FIG. 9 illustrates the bead element 100 incorporated in a wall assembly 50. When installed, the kickout 140 contacts the slotted header track 52 just above the open slots of the track leg. With the kickout 140 in contact with the leg of the header track 52, a seal is created between the bead element 100 and the header track 52 that inhibits or prevents the passage of air, smoke or sound through the open slots of the header track 52. The intumescent material strip 130 is positioned between the kickout 140 and the bubble gasket 120 and is protected from the elements.

Figure 10:
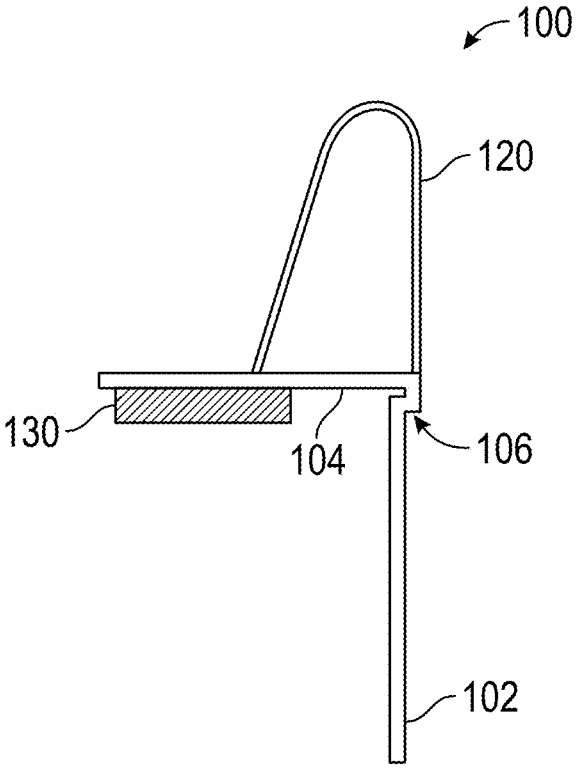
FIG. 10 is an end view of another fire-blocking bead element having a gasket and a fire-resistant material supported by a profile in the form of an angle, in which the fire-resistant material is located on an interior surface of the angle.
Figure 11:
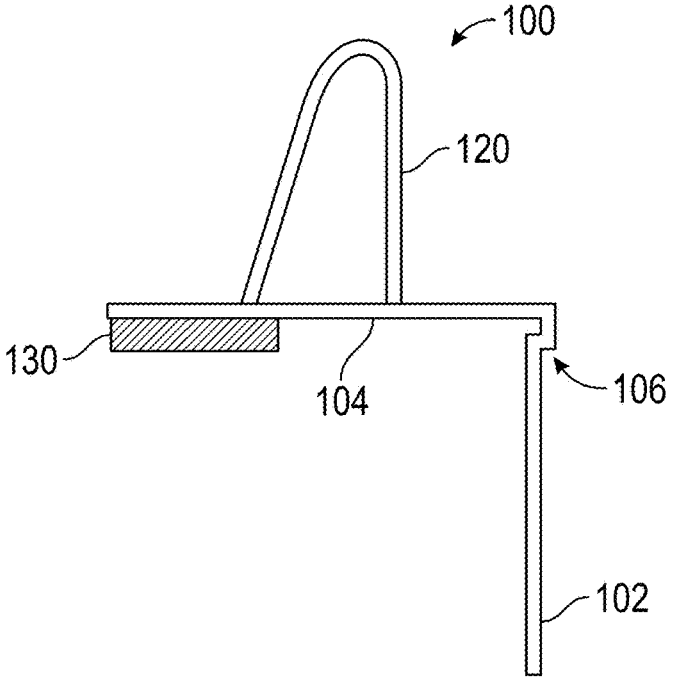
FIG. 11 is an end view of yet another fire-blocking bead element having a fire-resistant material supported by a profile in the form of an angle and a gasket supported at an inset location on the angle.
Figure 12:
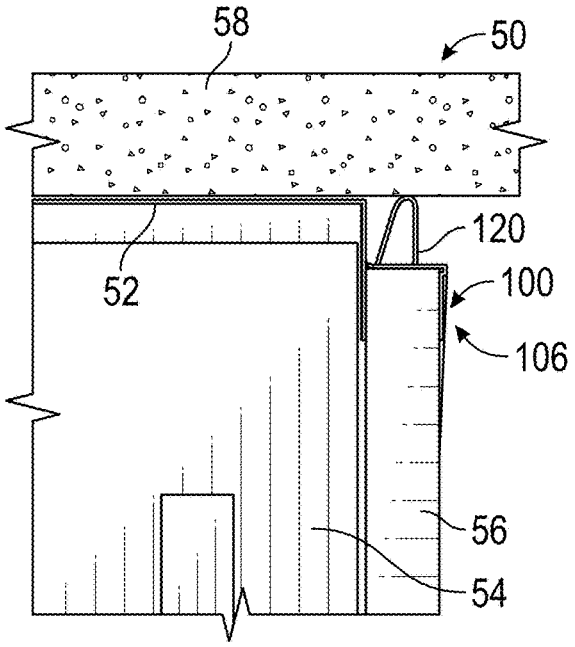
FIG. 12 is a sectional view of a wall assembly incorporating the fire-blocking bead element of FIG. 11.

FIGS. 10-12 illustrate two additional fire-blocking bead elements 100 and a wall assembly 50 incorporating one of the bead elements 100. The bead elements 100 are similar in many respects to the bead elements described above and is described below with an emphasis on the differences relative to the previously-described bead elements. Therefore, features that are not described below can be the same as or similar to the corresponding features of the other embodiments described herein, or can be of another suitable arrangement.

The bead element 100 of FIG. 10 includes a first leg 102 and a second leg 104 that cooperate to define a profile or angle 106. The bead element 100 also includes a gasket element or bubble gasket 120, which can be configured as discussed in connection with any embodiment herein. The bead element 100 further includes a fire-blocking or intumescent material strip 130. In the illustrated arrangement, the intumescent material strip 130 is located on an interior surface of the bead element 100 relative to the corner between the first leg 102 and the second leg 104. In particular, the intumescent material strip 130 is located on an interior or bottom surface of the second leg 104. In the illustrated arrangement, the intumescent material strip 130 is spaced from the corner and, in some configurations, is located at or near a free end of the second leg 104. By locating the intumescent material strip 130 on the bottom side of the second leg 104, or opposite the bubble gasket 120, the top side of the second leg 104 remains open such that the bubble gasket 120 can be located in any desired position. In some configurations, the intumescent material strip 130 can be utilized to create a seal with the header track, as in the embodiment of FIG. 5. The bead element 100 could also include a kickout 140, as in the embodiment of FIGS. 7 and 8.

In FIG. 10, the bubble gasket 120 is located at or adjacent the corner of the profile 106, in a position similar to the previous embodiments. In the bead element 100 of FIG. 11, the bubble gasket 120 is spaced away from the corner of the profile 106 along the second leg 104. The set back position of the bubble gasket 120 creates a recessed reveal in use, as described in connection with the embodiment of FIG. 4*a*. FIG. 12 illustrates the bead element 100 of FIG. 10 incorporated in a wall assembly.

Sound Gasket

In the 2012 IBC International Building Code, "Special Inspections" for firestop penetrations and joints went into effect for "High Rise Buildings" (structures greater than 75' above fire department access) as well as Category III or IV buildings and/or 'special occupancies' under Chapter 17. Special Inspections will require visual and/or destructive Testing. Destructive testing is when the special inspector will wait until the firestop product is fully cured and then take a "coupon" (removal of field installed firestop sealant or fire spray) of the sealant/spray to verify its depth at multiple locations at the bond lines. The bond line would be either at the penetration or the perimeter joint of the substrate interface and waiting for sealant to become fully cured will take several weeks, which will greatly impact the project schedule. The Special Inspector would need to obtain the average Shrinkage Value of the material, which will be supplied by the sealant manufacturer and the inspector must compare that data with the actual removed sealant from the project. If the bond line is not securely adhered to both sides of the joint, or if the correct amount of sealant by volume is not installed per the manufacturer's recommendations, the sealant joint may fail inspection and the sealant will have to be removed and properly reinstalled.

This new requirement in the IBC is forcing builders to look to other means and methods for sealing joints. In general, field applied sealants have been the most common way to seal building joints from fire, smoke and sound. But over the years, sealants have proven to be problematic, which is one of the reasons for the intense scrutiny placed on building joints in the newly revised 2012 IBC. Sealants by nature will shrink as they cure, and when the sealant shrinks it tends to pull away from the drywall, breaking the bond line and leaving a visible separation crack. Separation cracks will allow smoke and sound to pass through the joint, therefore compromising the effectiveness of the building joint.

Compounding the problem is the framing screws that are used on the top (header) and bottom tracks to secure the vertical framing studs within the track. The head of the framing screws protrudes about three-thirty-seconds inch (3/32") off the surface of the track. This protrusion causes the wall board to flare out away from the track as it passes over each framing screw. Framing screws are generally located every 16" to 24" on center along the length of the track. When the wall board flares out around the framing screws, gaps are created between the drywall and the track. Gaps result in sound flanking paths that can greatly reduce the STC sound performance of the wall. In addition, these gaps can create pathways for smoke to pass from one side of the wall to the other.

Figure 13:
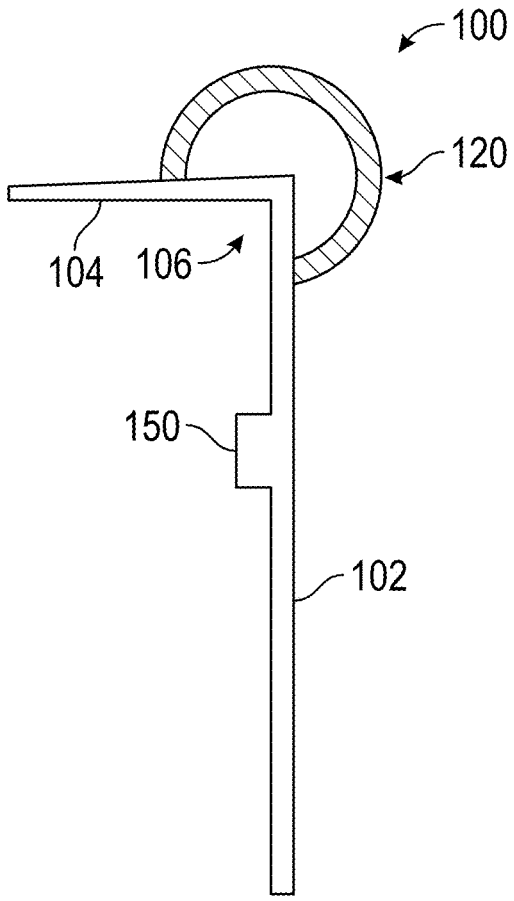
FIG. 13 is an end view of a sound blocking bead element having a gasket supported by a profile in the form of an angle.

One or more embodiments disclosed herein create an improved seal for building joints that will not shrink or pull away from the drywall and do not rely on utilizing traditional sealant. In particular, FIG. 13 illustrates an embodiment of a bead element 100 in the form of a sound gasket. The sound gasket 100 is configured to create a seal at the head-of-wall gap to reduce the transmission of sound in comparison to an unsealed stud wall assembly or a traditionally sealed stud wall assembly in which the sealant has shrunk or separated, as described above. The sound gasket 100 is similar in many respects to the bead elements described above and is described below with an emphasis on the differences relative to the previously-described bead elements. Therefore, features that are not described below can be the same as or similar to the corresponding features of the other embodiments described herein, or can be of another suitable arrangement.

FIG. 13 is an end view of a cross-sectional view of the sound gasket 100, which has a first leg 102 and a second leg 104 that cooperate to form an L-shaped profile 106. The sound gasket 100 also include a sealing element, such as a bubble gasket 120. The illustrated bubble gasket 120 has a part-circular cross-sectional shape and has ends coupled to each of the first leg 102 and the second leg 104. The bubble gasket 120 encloses the outer surface of the corner between the first leg 102 and the second leg 104.

The profile 106 of the sound gasket 100 includes a protrusion, such as a protruding rib 150 on an interior surface of the first leg 102. Preferably, the rib 150 is continuous along the length of the profile or sound gasket 100. The rib 150 can be square in cross-sectional shape; however, other suitable shapes can also be used. The rib 150 is configured to contact the header track 52 and space at least a lower portion of the first leg 102 away from the header track 52 to accommodate a head of the stud fastener between the first leg 102 and the leg of the header track 52. As a result, the exterior surface of the first leg 102 creates a substantially planar surface against which the wall board 56 can seal, despite the presence of the fastener heads. The bubble gasket 120 creates a seal with the ceiling 58 so that the head-of-wall gap is adequately sealed against the transmission of sound.

Figure 14:
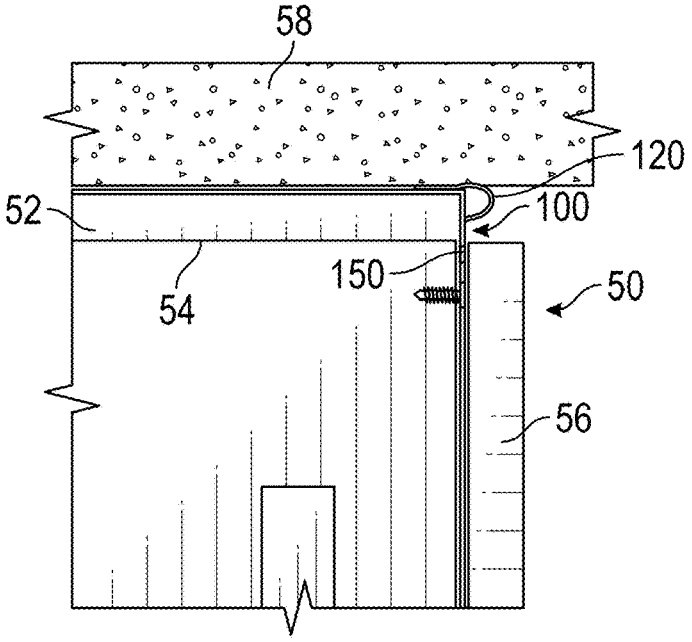
FIG. 14 is a sectional view of a wall assembly incorporating the sound blocking bead element of FIG. 13.
Figure 15:
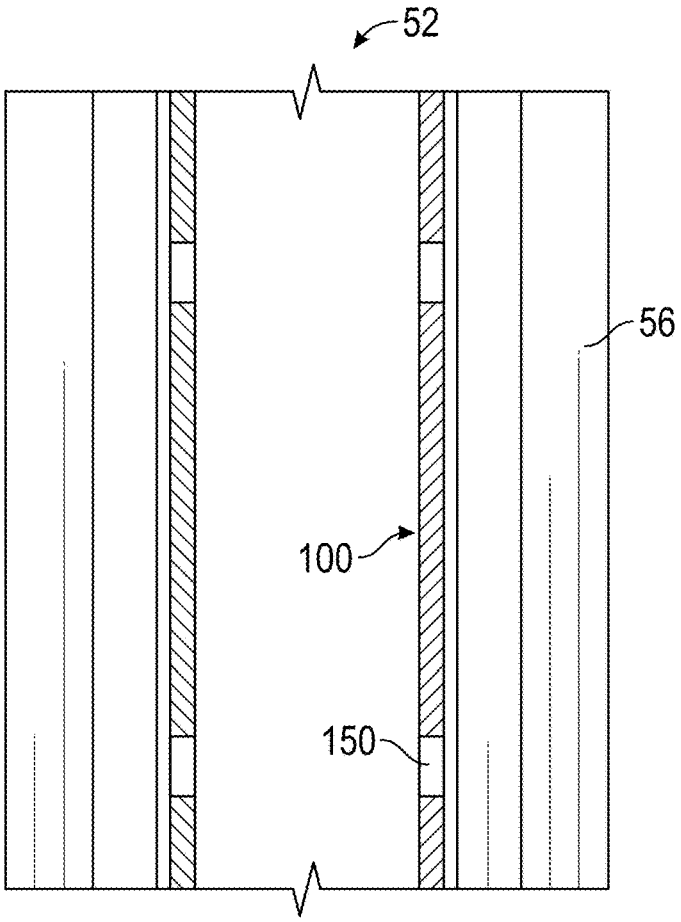
FIG. 15 is a top view of the wall assembly of FIG. 14.

FIGS. 14 and 15 illustrate the sound gasket 100 installed in a wall assembly 50. FIG. 14 is a side view of the wall assembly 50 and illustrates the space created by the rib 150, which accommodates the fastener head between the header track 52 and the first leg 102. FIG. 14 also illustrates the seal of the wall board 56 against the sound gasket 100 and the seal of the bubble gasket 120 against the ceiling 58. FIG. 15 is a top view of the wall assembly 50 illustrating how the sound gasket 100 accommodates the fastener heads, while providing a flat surface against which the wall board 56 can rest, and which avoids the situation in which the wall board flares out around the fastener heads as occurs in prior art constructions.

Unlike the prior bead elements, the sound gasket 100 is installed underneath the wall board 56. That is, the sound gasket 100 is positioned between the header track 52 and the wall board 56. In some configurations, the sound gasket 100 is configured to be friction fit over the leg of the field installed top (header) and/or bottom track prior to installing the wall board 56 over the face of the framing studs 54. The hollow bubble gasket 120 located on the outer corner is flexible and able to conform to uneven overhead structures 58, such as post-tension concrete slabs. This seal is what inhibits or prevents smoke or sound from passing over the top web of the track as it is very difficult to secure the metal track to the overhead concrete slab in a manner that can provide a tight seal to prevent smoke or sound passage.

In some configurations, the horizontal second leg 104 is configured to work as a wedge, as the free end is thinner and gradually gets thicker toward the corner of the profile 106. When the second leg 104 of the sound gasket 100 is tapped into place over the web of the header or bottom track, the hollow bubble gasket 120 will also provide a locking mechanism as the hollow bubble gasket 120 conforms to the surface of the concrete and still allow flexibility so that the seal will stay in contact even as the building moves during construction.

The vertical first leg 102 covers the flange or leg of the metal framing track 52 and by doing so provides smoke and sound protection. This is advantageous since the header track 52 typically has a series of vertical slots to accommodate the stud fasteners, which if left unprotected will allow a great deal of smoke and sound to pass. The vertical first leg 102 of the sound gasket 100 provides a permanent seal to prevent smoke or sound from passing through the framing members, in contrast to sealants that tend to shrink, as described above.

In some configurations, the sound gasket 100 is constructed completely from vinyl, plastic, rubber or any combination thereof—or of other similar materials. These types of materials may not hold up well to elevated heat from a fire, but they will contribute greatly to smoke and sound rated walls. In metal stud framed sound wall assemblies it is desirable that the materials used remain flexible. The characteristics of the vinyl (plastic, rubber or similar material) sound gasket 100 will not change over time and, therefore, the STC sound ratings will not be compromised over time.

Fire-Rated Reveals

FIGS. 16-24 illustrate several variations of a fire-blocking component, in the form of fire-rated reveal components, or fire-rated reveals. The fire-rated reveals are configured to cooperate with one or more pieces or sections of wall board to create an aesthetic reveal gap within or along the edge of a wall, preferably without requiring an extra layer of wall board. The fire-rated reveals generally include an elongate body or profile that carries a fire-resistant material, such as an intumescent strip.

Figure 16:
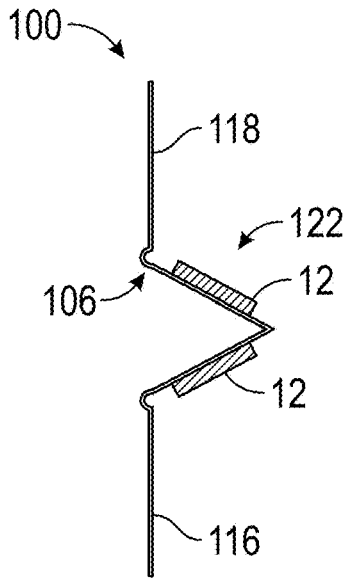
FIG. 16 is an end view of a fire-blocking reveal having a V-shape and incorporating a fire-resistant material.
Figure 17:
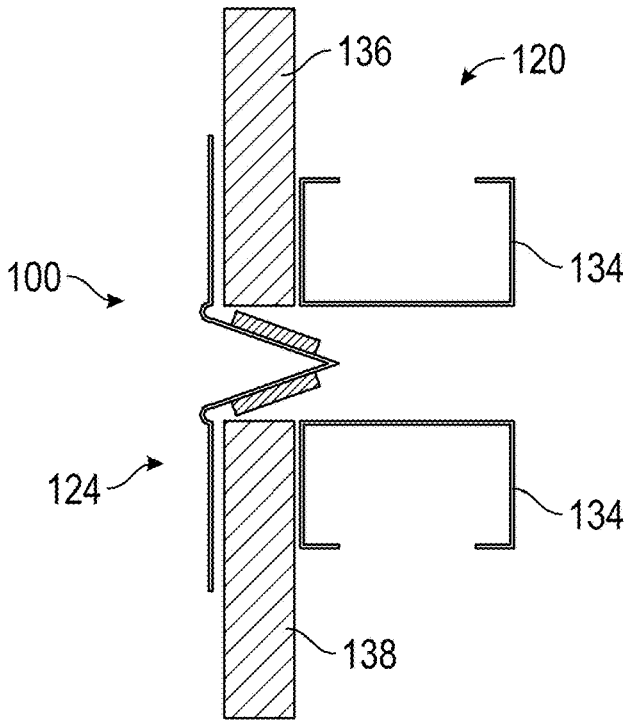
FIG. 17 is a sectional view of a wall assembly incorporating the fire-blocking reveal of FIG. 16.

FIGS. 16 and 17 illustrates an end view or cross-section of a fire-rated reveal 100 and a wall assembly 120 incorporating the fire-rated reveal 100, respectively. The fire-rated reveal 100 can provide a fire rating according to UL-2079 and ASTM E1966. The fire-rated reveal 100 can be sold in standard lengths (e.g., 5', 10', 12'). The profile 106 of the fire-rated reveal 100 can be formed partially or entirely of vinyl, aluminum, steel or another suitable material. The profile 106 can include a pair of flanges 116, 118. Between the flanges 116, 118, the fire-rated reveal 100 can include a V-shaped central portion 122. The V-shaped central portion 122 can support or otherwise include fire-resistant material 12. The fire-resistant material 12 can be included on one or both sides of the V-shaped central portion 122. The fire-resistant material 12 can be an intumescent material, such as an intumescent material strip.

The fire-rated reveal 100 can be used for protecting an exterior or interior wall assembly 120. The wall assembly 120 can include a first wall board portion or member 136, a second wall board portion or member 138 and/or one or more studs 134. The wall assembly 120 can define a reveal gap 124. The reveal gap 124 can be a location in the wall that is absent of wall board or other backing material (e.g., between wall board members 136, 138). The reveal gap 124 can be oriented vertically, horizontally, or at an angle across the wall assembly 120, depending on the desired appearance.

The V-shaped central portion 122 can be installed within the reveal gap 124 of the wall assembly 120 between the ends and inset from the outer surface of the wall board members 136, 138. The flanges 116, 118 can be attached (e.g., with staples or other mechanical fasteners) to the respective wall board members 136, 138. Preferably, the flanges 116, 118 are perforated. That is, the flanges 116, 118 comprise a plurality of holes that allows joint compound to key into the holes to inhibit or prevent cracking of the joint compound. The fire-rated reveal 100 can provide a fire-block to the reveal gap 124 so that only one layer of wall board is necessary. In a prior art arrangement, a first layer of wall board would be arranged continuously without a gap and a second layer of wall board would be applied over the first layer and would include the reveal gap.

Figure 18:
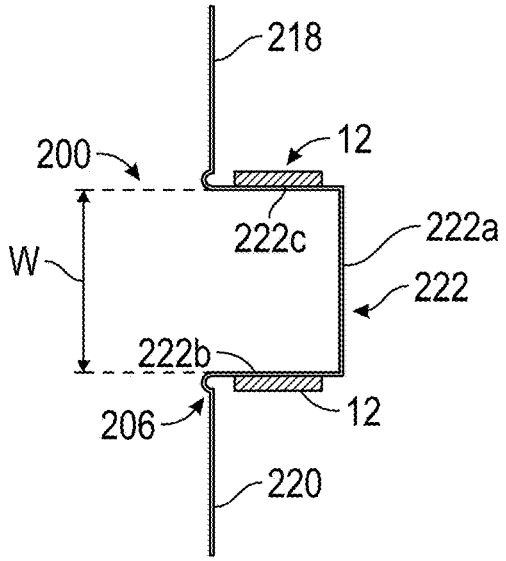
FIG. 18 is an end view of a fire-blocking reveal having a U-shape and incorporating a fire-resistant material.
Figure 19:
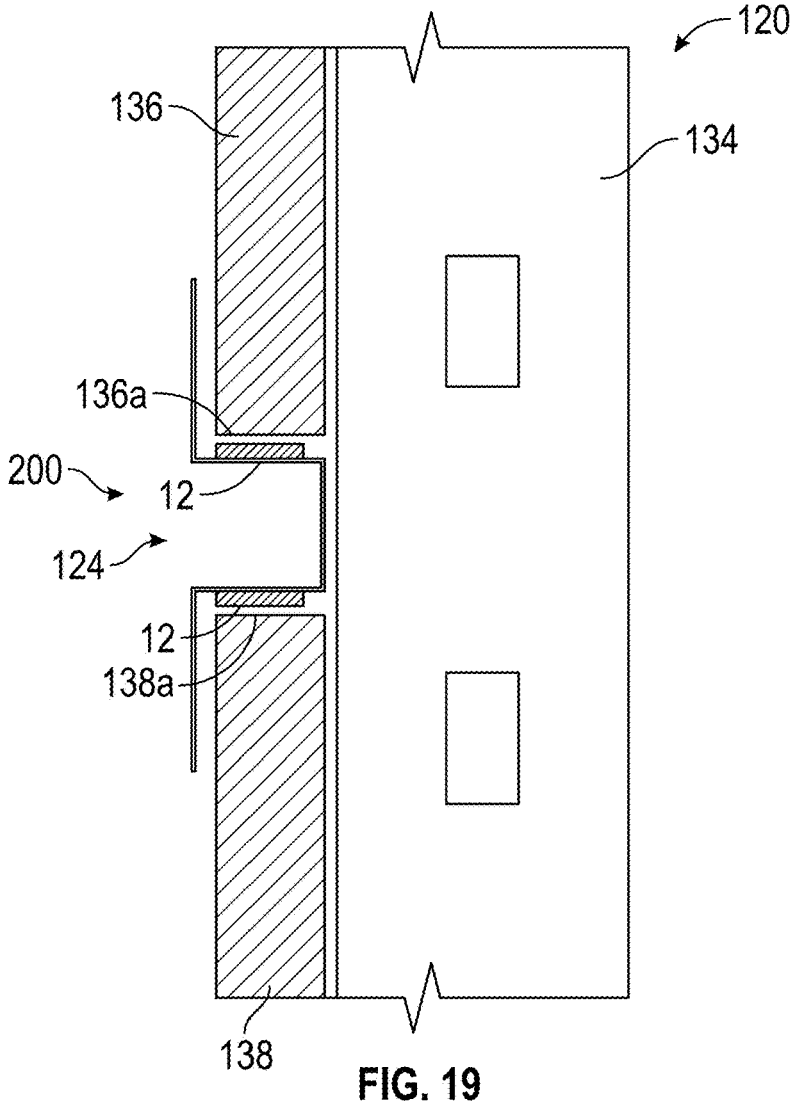
FIG. 19 is a sectional view of a wall assembly incorporating the fire-blocking reveal of FIG. 18.
Figure 20:
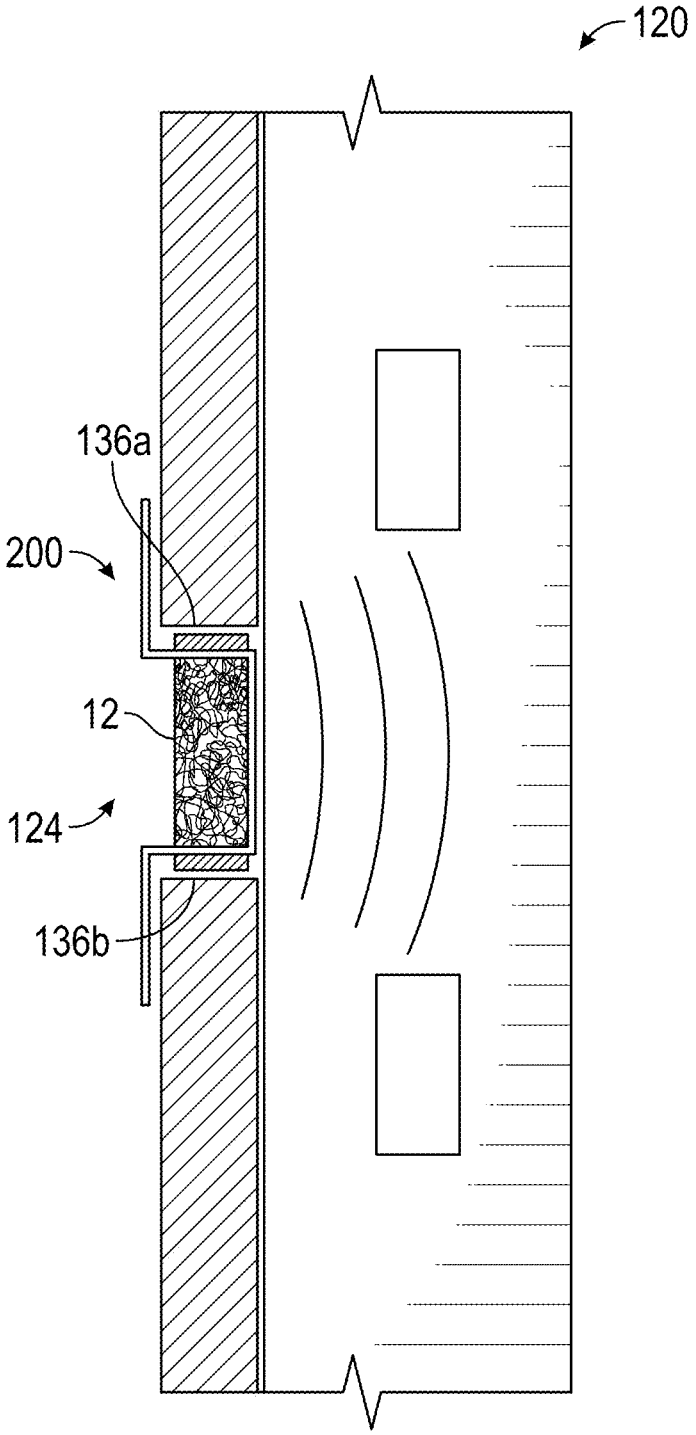
FIG. 20 is the sectional view of the wall assembly of FIG. 19 illustrating expansion of the fire-resistant material.

FIGS. 18 and 19 illustrate an end view or cross-section of a fire-rated reveal 200 and a wall assembly 120 incorporating the fire-rated reveal 200. The fire-rated reveal 200 can be similar in many respects to the fire-rated reveal 100 and is described below with an emphasis on the differences relative to the fire-rated reveal 100. Therefore, features that are not described below can be the same as or similar to the corresponding features of the fire-rated reveal 100 or other embodiments of a fire-block component described herein, or can be of another suitable arrangement.

The fire-rated reveal 200 can be sold in standard lengths (e.g., 5', 10', 12'). The profile 206 of the fire-rated reveal 200 can be formed partially or entirely of vinyl, aluminum, steel or another suitable material. The profile 206 of the fire-rated reveal 200 can include one or more (e.g., a pair of) flanges 218, 220. Between the flanges 218, 220 can be a central portion 222. The central portion 222 can have a rectangular shaped cross-section. The central portion 222 can include a central panel 222*a*, a side panel 222*b*, and/or a side panel 222*c*. The side panels 222*b*, 222*c* can be orthogonal with respect to the central panel 222*a*. The side panels 222*b* and/or 222*c* can support or otherwise include the fire-resistant material 12.

The fire-resistant material 12 can be in the form of one or more adhesive intumescent material strips applied to the central portion 222. Advantageously, the fire-resistant material 12 can have an expansion temperature that is below the melt temperature of the material of the profile 206 of the fire-rated reveal 200. In some implementations, vinyl melts at about 500° F. and aluminum at about 1200° F., while the intumescent expands at about 375° F. The fire-resistant material 12 can be attached on an outer side of the central portion 222 so that the fire-resistant material 12 faces the ends of the wall board members 136, 138. The central portion 222 can have a width W. The width W can be between one-quarter inch (¼") and three inches (3"). However, the width W is not limited to this range.

The fire-rated reveal 200 can be installed within the wall assembly 120, as shown in FIG. 19. The fire-rated reveal 200 can be a single step application for fire-blocking the wall assembly 120. The fire-rated reveal 200 installed within the wall assembly 120 can meet the standards of UL-2079 and ASTM E1966.

The central portion 222 can be installed within the reveal gap 124. The flanges 218, 220 can be attached (e.g., with adhesives and/or mechanical fasteners) with outer surfaces of the respective wall board members 136, 138. The flanges 218, 220 can be covered in joint compound (e.g., plaster or mud) to blend into the material of the wall board 136, 138.

The side panels 222*b*, 222*c* can be aligned with planar edges 136*a*, 136*b* of the wall board members 136, 138, respectively. The fire-resistant material 12 can be placed between the planar edges 136*a*, 136*b* of the wall board members 136, 138 and the panels 222*b*, 222*c*, respectively. As shown further in FIG. 20, when there is a fire event, the fire-resistant material 12 can expand in a direction that is perpendicular to the planar edges 136*a*, 136*b* of the wall board members 136, 138. Accordingly, the reveal gap 124 can be efficiently closed by the expanding fire-resistant material 12.

Advantageously, the cross-sectional shape of the central portion 222 can be used to enhance the architectural appearance of the wall assembly 120. The rectangular cross-sectional shape of the central portion 222 can form a reveal. Desirably, as compared with the V-shaped central portion 122 of the fire-block 100, the central portion 222 does not visually narrow to a point. Moreover, the central portion 222 can be easier to clean because of the open orientation of the central panel 222*a* with the side panels 222*b*, 222*c*.

Fire-Rated Z-Shaped Reveal

Figure 21:
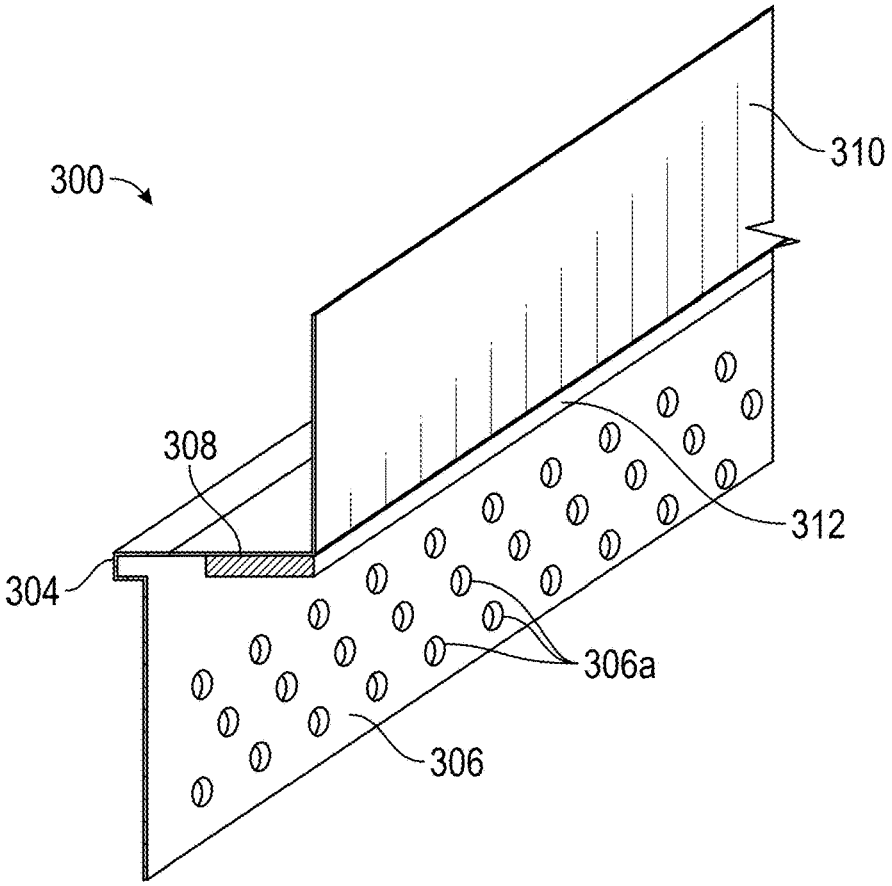
FIG. 21 is a perspective view of a head-of-wall fire-blocking reveal.
Figure 22:
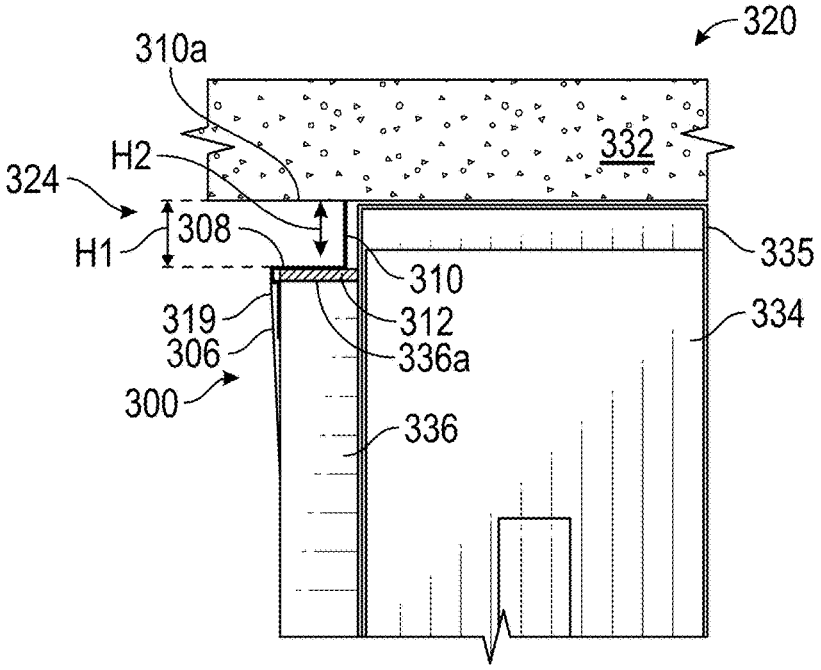
FIG. 22 is a sectional view of a wall assembly incorporating the fire-blocking reveal of FIG. 21.

FIGS. 21 and 22 illustrate a Z-shaped fire-rated reveal 300 and a wall assembly 320 incorporating the Z-shaped fire-rated reveal 300, respectively. The fire-rated reveal 300 can be similar in many respects to the fire-rated reveals 100 and 200, and is described below with an emphasis on the differences relative to the fire-rated reveals 100, 200. Therefore, features that are not described below can be the same as or similar to the corresponding features of the fire-rated reveal 100, 200 or other embodiments of a fire-block component described herein, or can be of another suitable arrangement.

The fire-rated reveal 300 can be sold in standard lengths (e.g., 5', 10', 12'). The fire-rated reveal 300 can provide fire rating according to UL-2079 and ASTM E1966. The reveal 300 can include a Z-shaped profile layer 304. The Z-shaped layer can be constructed in whole or in part from vinyl, aluminum, steel or other suitable material. The fire-rated reveal 300 can include a fire-resistant material 312. The fire-resistant material 312 can be an intumescent material. In some configurations, the fire-resistant material 312 is an adhesive intumescent material strip.

The Z-shaped layer 304 can include a lower flange 306, an upper flange 310 and/or a central flange 308. The central flange 308 can connect the upper flange 310 and the lower flange 306. The central flange 308 can be generally planar, although this is not required. The upper flange 310 can be generally planar, although this is not required. The central flange 308 can be connected at one end with the upper flange 310. The angle of connection between the upper flange 310 and the central flange 308 can be generally orthogonal. The lower flange 306 can be generally planar, although this is not required. The lower flange 306 can be connected on one end with the central flange 308. The central flange 308 can be generally orthogonal with the lower flange 306. The upper flange 310 and the lower flange 306 can be connected on opposite ends of the central flange 308. In other implementations, the upper and/or lower flanges 310, 306 can be at non-orthogonal angles with respect to the central flange 308.

The flanges 306, 308, 310 can have various lengths. The lengths can be between one-half inch (½") and two inches (2"), although this is not required. The central flange 308 can be made available in varying lengths, which can be based on the number of layers of wall board 336 in the wall assembly 320. The lower flange 306 (in the illustrated orientation) can include a plurality of perforations 306*a*.

In a conventional fire-block for a control joint, fire sealant (e.g., mineral wool) would fill-in any gap in the control joint. Thus, architectural reveals cannot be fire-blocked using conventional methods without filling in the reveal gap. Here, the fire-rated reveal 300 can be used to fire-block architectural reveals that include a gap. FIG. 22 shows the reveal 300 installed within a head of wall assembly 320. The wall assembly 320 can include a fixed overhead structure 332, a header track 335, a plurality of studs 334, and/or a wall board 336. The wall board 336 can be connected to the studs 334. The studs 334 can be connected to the header track 335. The header track 335 can be a solid header track such that the wall board 336/studs 334 are fixed relative to the header track 335 or the header track 335 can be a slotted header track that allows movement between the wall board 336/studs 334 and the fixed structure 332.

The wall assembly 320 can include a reveal gap 324. The reveal gap 324 can be between an upper end surface 336*a* of the wall board 336 and the fixed structure 332. The reveal gap 324 can have a height H1. In a dynamic head-of-wall arrangement, the height H1 of the reveal gap 324 can be variable as the wall board 336 and the studs 334 move with respect to the header track 335 and the fixed structure 332.

The fire-rated reveal 300 can be installed at least partially within the reveal gap 324. The fire-rated reveal 300 can be installed in a single step application. For example, the fire-rated reveal 300 can be adhered or fastened to the wall board 336. The central flange 308 can be installed within the reveal gap 324. The central flange 308 and/or the fire-resistant material 312 can rest on an upper end surface 336*a* of the wall board 336. The fire-resistant material 312 can be placed on an unexposed side of the central flange 308 adjacent the end 336*a* of the wall board 336. The central flange 308 can be positioned parallel with the upper end 336*a* of the drywall. The central flange 308 can run parallel with the upper end 336*a*.

The upper flange 310 can be installed within the reveal gap 324. An upper end 310*a* of the upper flange 310 can contact the fixed structure 332. The upper flange 310 can have a height H2 from the central flange 308. The height H2 can be related to the maximum opening width of the reveal gap 324 (e.g., height H1). In some configurations, the height H2 will be slightly smaller than the height H1 to account for the thicknesses of the fire-resistant material 312 and the central flange 308. The upper flange 310 can be flexible with respect to the central flange 308. Accordingly, as the reveal gap 324 narrows (H1 decreases), the upper flange 310 can flex to maintain contact with the fixed structure 332. In other applications, the reveal gap 324 can be a constant size and the upper flange 310 can be relatively or substantially rigid.

The lower flange 306 can be placed against an outer surface of the wall board 336. A joint compound 319 or other suitable finishing material can be applied to the wall board 336 over the lower flange 306 to mask its appearance. The joint compound 319 can engage the perforations 306*a* to improve the connection between the joint compound 319 and the lower leg 306 and/or to prevent cracking.

The fire-resistant material 312 can expand in response to being heated. The expansion can move upwardly (e.g., perpendicularly) from the upper end 336*a* towards the fixed structure 332. The expansion can occur between the upper flange 310 and the header track 335 or the force of the expansion can move the central flange 308 and upper flange 310 fully or partially out of the reveal gap 324. In some cases, the profile 304 will begin to melt or disintegrate, which can facilitate expansion of the fire-resistant material 312. The expansion of the fire-resistant material 312 can substantially or fully close and seal the reveal gap 324 against the passage of fire or smoke for at least a period of time.

Figure 23:
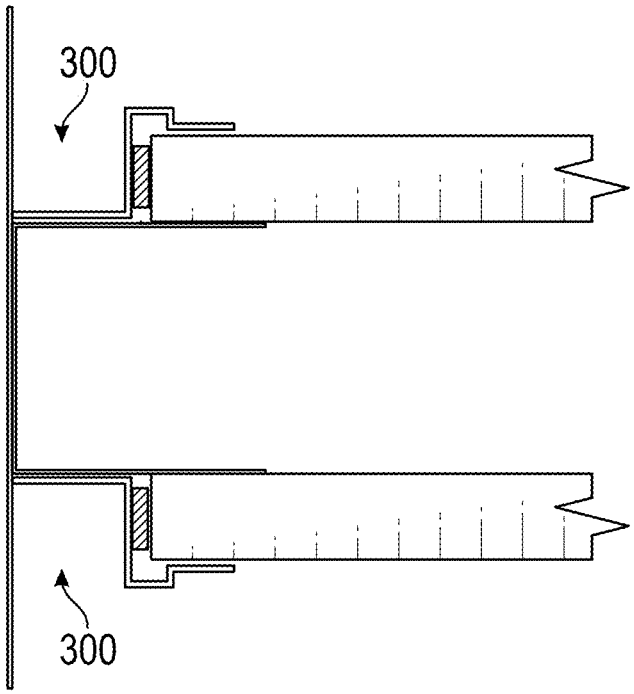
FIG. 23 is a sectional view of a wall assembly incorporating a fire-blocking reveal similar to the reveal of FIGS. 21 and 22, except in a vertical orientation.
Figure 24:
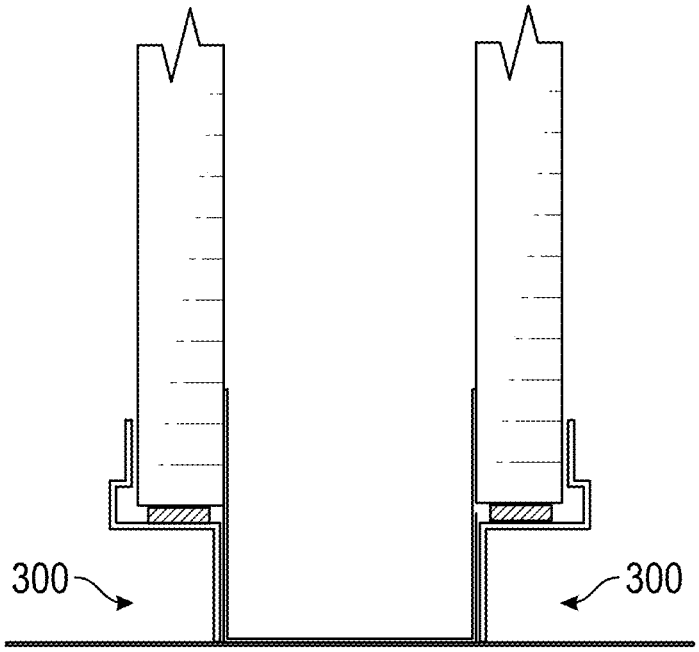
FIG. 24 is a sectional view of a wall assembly incorporating a fire-blocking reveal similar to the reveal of FIGS. 21 and 22, except in a base-of-wall location.

The Z-shaped fire-rated reveal 300 can be used in or modified for use in a variety of reveals or other gaps in a construction. For example, FIG. 23 shows a vertically oriented reveal in cross-section as viewed from above. The reveal 300 can be used in a vertical wall gap on one or both sides of the wall. FIG. 24 shows a base of wall assembly in cross-section. The reveal 300 can be used in a base of wall assembly on one or both sides of the wall. In such an arrangement, the reveal 300 is used in an upside-down orientation relative to the orientation of FIGS. 21 and 22.

CONCLUSION

It should be emphasized that many variations and modifications may be made to the herein-described embodiments, the elements of which are to be understood as being among other acceptable examples. All such modifications and variations are intended to be included herein within the scope of this disclosure and protected by the following claims. Moreover, any of the steps described herein can be performed simultaneously or in an order different from the steps as ordered herein. Moreover, as should be apparent, the features and attributes of the specific embodiments disclosed herein may be combined in different ways to form additional embodiments, all of which fall within the scope of the present disclosure.

Conditional language used herein, such as, among others, "can," "could," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without author input or prompting, whether these features, elements and/or states are included or are to be performed in any particular embodiment.

Moreover, the following terminology may have been used herein. The singular forms "a," "an," and "the" include plural referents unless the context clearly dictates otherwise. Thus, for example, reference to an item includes reference to one or more items. The term "ones" refers to one, two, or more, and generally applies to the selection of some or all of a quantity. The term "plurality" refers to two or more of an item. The term "about" or "approximately" means that quantities, dimensions, sizes, formulations, parameters, shapes and other characteristics need not be exact, but may be approximated and/or larger or smaller, as desired, reflecting acceptable tolerances, conversion factors, rounding off, measurement error and the like and other factors known to those of skill in the art. The term "substantially" means that the recited characteristic, parameter, or value need not be achieved exactly, but that deviations or variations, including for example, tolerances, measurement error, measurement accuracy limitations and other factors known to those of skill in the art, may occur in amounts that do not preclude the effect the characteristic was intended to provide.

Numerical data may be expressed or presented herein in a range format. It is to be understood that such a range format is used merely for convenience and brevity and thus should be interpreted flexibly to include not only the numerical values explicitly recited as the limits of the range, but also interpreted to include all of the individual numerical values or sub-ranges encompassed within that range as if each numerical value and sub-range is explicitly recited. As an illustration, a numerical range of "about 1 to 5" should be interpreted to include not only the explicitly recited values of about 1 to about 5, but should also be interpreted to also include individual values and sub-ranges within the indicated range. Thus, included in this numerical range are individual values such as 2, 3 and 4 and sub-ranges such as "about 1 to about 3," "about 2 to about 4" and "about 3 to about 5," "1 to 3," "2 to 4," "3 to 5," etc. This same principle applies to ranges reciting only one numerical value (e.g., "greater than about 1") and should apply regardless of the breadth of the range or the characteristics being described. A plurality of items may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary. Furthermore, where the terms "and" and "or" are used in conjunction with a list of items, they are to be interpreted broadly, in that any one or more of the listed items may be used alone or in combination with other listed items. The term "alternatively" refers to selection of one of two or more alternatives, and is not intended to limit the selection to only those listed alternatives or to only one of the listed alternatives at a time, unless the context clearly indicates otherwise.

What is claimed is:

1. A fire-blocking bead element to provide a fire-rated seal to a gap of a wall assembly, the fire-blocking bead element comprising:

an L-shaped profile structure, comprising:

a first leg, the first leg comprising a free edge portion and an attachment portion, the first leg configured to extend along an outward-facing surface of a wall board of the wall assembly in use; and a second leg, the second leg comprising a first surface and a second surface opposite the first surface, wherein the second leg is coupled to the first leg at the attachment portion of the first leg to form a corner of the profile structure, wherein the second leg is configured to be located, in use, in a space between an edge of the wall board and an adjacent structure, the space having a height defined and a width defined by a width of the edge of the wall board;

a gasket element positioned on the first surface of the second leg and configured to contact the adjacent structure in use, wherein the gasket element is compressible to conform to an irregular surface of the adjacent structure, and the gasket element is spaced away from the corner of the profile structure; and a fire blocking material strip located on the second surface of the second leg and configured to expand in response to heat, wherein the fire blocking material strip comprises a first side and a second side opposite the first side, wherein the first side is coupled to the second leg and the second side is configured to contact the edge of the wall board in use in use;

wherein the second leg is configured to locate the gasket element and the fire blocking material strip in the space between the edge of the wall board and the adjacent structure in use.

2. The fire-blocking bead element of claim 1, wherein the first leg and the second leg form a unitary structure.

3. The fire-blocking bead element of claim 2, wherein the unitary structure comprises vinyl.

4. The fire-blocking bead element of claim 1, wherein the fire blocking material strip comprises intumescent material.

5. The fire-blocking bead element of claim 1, wherein the first leg has a width of about 1⅛".

6. The fire-blocking bead element of claim 1, wherein the profile structure further comprises a tear off strip coupled to the first leg.

7. The fire-blocking bead element of claim 1, wherein the gasket element is a bubble gasket.

8. The fire-blocking bead element of claim 7, wherein the bubble gasket is hollow.

9. The fire-blocking bead element of claim 1, wherein the edge of the wall board is an upper edge of the wall board, a lower edge of the wall board, or a side edge of the wall board.

10. The fire-blocking bead element of claim 1, wherein the first leg comprises a plurality of perforations.

11. The fire-blocking bead element of claim 1, wherein the attachment portion comprises an L-shaped offset.

12. The fire-blocking bead element of claim 1, wherein the gap is oriented vertically, horizontally, or at an angle across the wall assembly.

13. A fire-rated wall assembly comprising:

a wall board;

an adjacent structure, the adjacent structure spaced from a peripheral edge surface of the wall board to form a gap;

a fire-blocking bead element, the fire-blocking bead element comprising:

a profile structure, comprising:

a first leg, the first leg comprising a first end and a second end opposite the first end, the second end including a terminal free edge, wherein the first leg is located along an outward-facing surface of the wall board of a wall; and a second leg, the second leg comprising a first surface and a second surface opposite the first surface, wherein the second leg is coupled to the first leg to form a generally L-shaped structure in cross-section having a corner, wherein the second leg is located between the peripheral edge surface of the wall board and the adjacent structure;

a gasket element positioned on the first surface of the second leg and disposed within the gap, wherein the gasket element is compressible to engage with the adjacent structure to seal across the gap; and a fire blocking material strip located on the second surface of the second leg and configured to expand in response to heat, wherein the fire blocking material strip comprises a first side and a second side opposite the first side, wherein the first side of the fire blocking material strip is connected to the second leg and the second side of the fire blocking material strip contacts the peripheral edge surface of the wall board and is disposed within the gap.

14. The fire-rated wall assembly of claim 13, wherein the adjacent structure is an overhead structure, a lower structure, or a side structure.

15. The fire-rated wall assembly of claim 14, wherein the first surface of the second leg is an upper surface, a lower surface, or an outer side surface.

16. The fire-rated wall assembly of claim 15, wherein the first end of the first leg comprises an offset from the second leg, the offset configured to receive a joint compound.

17. The fire-rated wall assembly of claim 16, wherein the gasket element is a bubble gasket.

18. The fire-rated wall assembly of claim 13, wherein the gasket element is spaced away from the corner.

19. The fire-rated wall assembly of claim 13, wherein the gap is oriented vertically, horizontally, or at an angle across the wall assembly.

* * * * *